US006145974A

United States Patent [19]

Shinada et al.

[11] Patent Number: 6,145,974

[45] **Date of Patent: *Nov. 14, 2000**

[54] INK-SUPPLIED PRINTER HEAD AND INK CONTAINER

[75] Inventors: Satoshi Shinada; Seiji Mochizuki; Yoshinori Miyazawa; Takao Kobayashi; Hisashi Koike; Yukiharu Suda, all of Suwa, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/488,534

[22] Filed: Jun. 7, 1995

Related U.S. Application Data

[63] Continuation-in-part of application No. 08/357,639, Dec. 16, 1994, abandoned.

[30] Foreign Application Priority Data

| | | | |
|---|---|---|---|
| Oct. 13, 1983 | [JP] | Japan | 58-191529 |
| Nov. 29, 1983 | [JP] | Japan | 58-224892 |
| May 22, 1984 | [JP] | Japan | 59-102841 |
| May 22, 1984 | [JP] | Japan | 59-102842 |
| May 22, 1984 | [JP] | Japan | 59-102843 |
| Sep. 16, 1994 | [JP] | Japan | 6-248516 |

[51] Int. Cl.[7] ..... B41J 2/175

[52] U.S. Cl. ..... 347/87; 347/86

[58] Field of Search ..... 347/86, 87; 400/124.1

[56] References Cited

U.S. PATENT DOCUMENTS

| | | | |
|---|---|---|---|
| 608,887 | 8/1898 | Melven . | |
| 1,321,785 | 11/1919 | Bronner . | |
| 1,569,470 | 1/1926 | Falder . | |
| 2,585,647 | 2/1952 | Gordon | 118/265 |
| 2,688,307 | 9/1954 | Nichols et al. . | |
| 2,747,543 | 5/1956 | Navikas | 118/264 |

(List continued on next page.)

FOREIGN PATENT DOCUMENTS

| | | | |
|---|---|---|---|
| 0 261 764 A1 | 3/1988 | European Pat. Off. . | |
| 0 408 241 | 1/1991 | European Pat. Off. . | |
| 0 488 829 | 6/1992 | European Pat. Off. | B41J 2/175 |
| 0 488 829 A2 | 6/1992 | European Pat. Off. . | |
| 0 514 632 | 11/1992 | European Pat. Off. | B41J 2/165 |
| 0 536 980 A2 | 4/1993 | European Pat. Off. . | |

(List continued on next page.)

OTHER PUBLICATIONS

Erturk, E. et al.: Ink Retention in a Color Thermal Inkjet Pen. In: Hewlett–Packard–Journal, Aug. 1988, pp. 41–44.

*Primary Examiner*—John Barlow
*Assistant Examiner*—Juanita Stephens
*Attorney, Agent, or Firm*—Stroock & Stroock & Lavan LLP

[57] ABSTRACT

An ink tank cartridge for an ink-jet type recording apparatus is provided. The ink tank cartridge comprises a plural number of first chambers and a plural number of second chambers adjacent to and associated with a first chamber, each pair of first and second chambers being formed as an integral unit. The ink tank cartridge also has a partition wall disposed in the cartridge which separates each second chamber from an associated first chamber, the two chambers communicating through a communicating hole positioned near the bottom of the partition wall disposed between the associated chambers. The communicating hole extends only a portion of the width that the partition wall. Finally, a plural number of ink supply ports, each extending through a wall of a respective one of the plural number of first chambers, supply ink to the exterior of the ink cartridge from each respective porous member of the plural number of porous members.

62 Claims, 14 Drawing Sheets

U.S. PATENT DOCUMENTS

| | | | |
|---|---|---|---|
| 3,018,756 | 1/1962 | Kilham | 118/264 |
| 3,097,597 | 7/1963 | Visser | 101/364 |
| 3,101,667 | 8/1963 | Siegel | 101/364 |
| 3,441,950 | 4/1969 | Miller | 346/140 |
| 3,599,566 | 8/1971 | Fish | 101/364 |
| 3,967,286 | 6/1976 | Andersson et al. | 346/140 |
| 4,017,871 | 4/1977 | Hubbard | 346/140 |
| 4,095,237 | 6/1978 | Amberntsson et al. | 346/140 |
| 4,183,030 | 1/1980 | Kaieda et al. | 346/140 |
| 4,183,031 | 1/1980 | Kyser et al. | 346/140 R |
| 4,194,846 | 3/1980 | Zerillo | 400/124 |
| 4,279,519 | 7/1981 | Shiurila | 400/124 |
| 4,336,767 | 6/1982 | Wada | 118/264 |
| 4,353,654 | 10/1982 | Shiurila | 400/124 |
| 4,368,478 | 1/1983 | Koto | 347/86 |
| 4,400,102 | 8/1983 | Shiurila et al. | 400/124 |
| 4,403,874 | 9/1983 | Payne et al. | 400/124 |
| 4,456,393 | 6/1984 | Gomi et al. | 400/124 |
| 4,484,827 | 11/1984 | Price, Jr. | 401/205 |
| 4,500,222 | 2/1985 | Clading-Boel . | |
| 4,506,277 | 3/1985 | Terasawa | 346/140 |
| 4,553,865 | 11/1985 | Ikeda et al. | 400/124 |
| 4,589,000 | 5/1986 | Koto et al. . | |
| 4,620,202 | 10/1986 | Koto et al. | 347/87 |
| 4,630,758 | 12/1986 | Mutoh | 222/189 |
| 4,695,824 | 9/1987 | Tazaki | 346/140 |
| 4,794,409 | 12/1988 | Cowger et al. | 346/140 |
| 4,855,762 | 8/1989 | Suzuki | 346/140 |
| 4,920,362 | 4/1990 | Cowger | 347/87 |
| 4,968,998 | 11/1990 | Allen | 346/75 |
| 4,969,759 | 11/1990 | Suzuki et al. | 400/124 |
| 5,056,433 | 10/1991 | Murphy et al. | 101/364 |
| 5,119,115 | 6/1992 | Buat et al. | 346/140 |
| 5,156,470 | 10/1992 | Suzuki et al. | 400/124 |
| 5,156,471 | 10/1992 | Suzuki et al. | 400/124 |
| 5,156,472 | 10/1992 | Suzuki et al. | 400/124 |
| 5,156,473 | 10/1992 | Suzuki et al. | 400/124 |
| 5,158,377 | 10/1992 | Suzuki et al. | 400/124 |
| 5,174,665 | 12/1992 | Suzuki et al. | 400/124 |
| 5,221,148 | 6/1993 | Suzuki et al. | 400/124 |
| 5,262,802 | 11/1993 | Karita et al. | 347/87 |
| 5,280,300 | 1/1994 | Fong et al. | 346/1.1 |
| 5,289,212 | 2/1994 | Carlotta | 346/140 |
| 5,328,279 | 7/1994 | Suzuki et al. | 400/124 |
| 5,444,474 | 8/1995 | Ohtsubo et al. | 347/87 |
| 5,453,771 | 9/1995 | Wasuda et al. | 347/86 |
| 5,488,401 | 1/1996 | Mochizuki et al. | 347/86 |
| 5,489,932 | 2/1996 | Ceschin | 347/87 |
| 5,509,140 | 4/1996 | Koitabashi et al. | 347/87 |
| 5,526,030 | 6/1996 | Baldwin et al. | 347/87 |
| 5,560,720 | 10/1996 | Suzuki et al. . | |
| 5,603,577 | 2/1997 | Suzuki et al. . | |
| 5,607,242 | 3/1997 | Suzuki et al. . | |
| 5,615,957 | 4/1997 | Suzuki et al. . | |
| 5,619,238 | 4/1997 | Higuma | 347/86 |
| 5,621,446 | 4/1997 | Tanaka | 347/85 |
| 5,622,439 | 4/1997 | Suzuki et al. . | |
| 5,784,088 | 7/1998 | Ujita | 347/86 |
| 5,790,158 | 8/1998 | Shinada | 347/86 |

FOREIGN PATENT DOCUMENTS

| | | | |
|---|---|---|---|
| 0 567 308 A2 | 4/1993 | European Pat. Off. | B41J 2/175 |
| 0 542 247 | 5/1993 | European Pat. Off. | B41J 2/175 |
| 542247 A2 | 5/1993 | European Pat. Off. . | |
| 0 580 433 A1 | 7/1993 | European Pat. Off. | B41J 2/175 |
| 0 581 531 A1 | 7/1993 | European Pat. Off. . | |
| 0 553 535 A1 | 8/1993 | European Pat. Off. . | |
| 0 561 081 | 9/1993 | European Pat. Off. . | |
| 562733 | 9/1993 | European Pat. Off. | 347/87 |
| 0 580 433 | 1/1994 | European Pat. Off. | B41J 2/175 |
| 0 580 433 A1 | 1/1994 | European Pat. Off. . | |
| 0 581 531 | 2/1994 | European Pat. Off. | B41J 2/175 |
| 0 598 481 | 5/1994 | European Pat. Off. | B41J 2/175 |
| 0 633 138 A2 | 7/1994 | European Pat. Off. | B41J 2/175 |
| 605385 A2 | 7/1994 | European Pat. Off. . | |
| 0 611 656 | 8/1994 | European Pat. Off. . | |
| 0 640 484 A2 | 8/1994 | European Pat. Off. | B41J 2/175 |
| 0 624 475 | 11/1994 | European Pat. Off. | B41J 2/175 |
| 0 624 475 A2 | 11/1994 | European Pat. Off. . | |
| 0 624 475 A3 | 11/1994 | European Pat. Off. . | |
| 0 625 424 A2 | 11/1994 | European Pat. Off. . | |
| 0 631 874 A2 | 1/1995 | European Pat. Off. . | |
| 0 633 138 | 1/1995 | European Pat. Off. | B41J 2/175 |
| 0 639 462 A2 | 2/1995 | European Pat. Off. . | |
| 0 640 482 | 3/1995 | European Pat. Off. | B41J 2/175 |
| 0 640 482 A2 | 3/1995 | European Pat. Off. . | |
| 0 640 484 | 3/1995 | European Pat. Off. . | |
| 0 646 465 A2 | 4/1995 | European Pat. Off. . | |
| 0 665 108 A2 | 8/1995 | European Pat. Off. . | |
| 0 633 138 | 9/1995 | European Pat. Off. . | |
| 0 672 527 | 9/1995 | European Pat. Off. . | |
| 2229320 | 12/1974 | France . | |
| 2546835 | 4/1977 | Germany | 400/124 |
| 3316298 | 11/1983 | Germany . | |
| 0 411 873 | 10/1994 | Germany . | |
| 50-99436 | 8/1975 | Japan . | |
| 54-8951 | 7/1979 | Japan . | |
| 42874 | 3/1980 | Japan | 400/470 |
| 55-42875 | 3/1980 | Japan | B41J 3/04 |
| 55-65560 | 5/1980 | Japan | B41J 3/04 |
| 55-166267 | 12/1980 | Japan . | |
| 57-63285 | 4/1982 | Japan | B41J 27/00 |
| 57-84867 | 5/1982 | Japan . | |
| 185168 | 11/1982 | Japan | 400/240.4 |
| 89377 | 5/1983 | Japan | 400/82 |
| 58-142861 | 8/1983 | Japan | B41J 3/04 |
| 188670 | 11/1983 | Japan | 400/240.4 |
| 58-166464 | 11/1983 | Japan | B41J 27/00 |
| 58-199159 | 11/1983 | Japan | B41J 3/04 |
| 59-21955 | 2/1984 | Japan | B41J 3/04 |
| 59-26342 | 2/1984 | Japan | B41J 3/04 |
| 59-41539 | 3/1984 | Japan . | |
| 59-59340 | 4/1984 | Japan | B41J 3/04 |
| 59-68985 | 5/1984 | Japan . | |
| 22952 | 1/1986 | Japan | 347/87 |
| 0 488 829 | 3/1992 | Japan | B41J 2/175 |
| 4-144755 | 5/1992 | Japan . | |
| 255122 | 9/1994 | Japan | 347/87 |
| 07137274 | 5/1995 | Japan . | |
| 2269784 | 2/1994 | United Kingdom . | |

INK-SUPPLIED PRINTER HEAD AND INK CONTAINER

This is a continuation-in-part application of application Ser. No. 08/357,639 filed Dec. 16, 1994 entitled INK-SUPPLIED PRINTER HEAD AND INK CONTAINER, now abandoned.

BACKGROUND OF THE INVENTION

The present invention relates generally to an ink-supplied printer head being supplied with ink from an ink supply tank and more particularly to an ink supply tank which allows for the continuous supply of ink to the printer head while avoiding adverse effects from temperature, atmospheric changes or vibrations. The present invention allows for a larger volume of ink in the ink supply tank and allows for a greater percentage of the ink in the tank to be transferred to the printer head. Also, the present invention comprises a tank with transparent sides so the user is able to easily determine the remaining quantity of ink, and also means for dampening of the unwanted movement of ink within the ink supply tank.

This invention also relates to an ink cartridge for an ink jet printer in which an ink jet recording head, and an ink cartridge are mounted on a movable carriage, and in particular an ink jet cartridge in which upon depletion of the ink from the old cartridge, is replaced with a new ink cartridge.

Ink supply systems for a wire dot matrix printer are known in which no ink ribbon is used, but ink is supplied from an ink tank to the distal ends of the wire and transferred from the wires directly to a sheet of print paper. Portions of these ink supply systems, including the supply tanks thereof, are also adaptable to be used in ink jet type printers.

In the prior art, improved ink storage and delivery was achieved by providing a porous member in an ink tank that essentially filled the tank and carried essentially the entire supply of ink. It was found that while this construction offered substantial improvement over the prior art, the use of the full porous member limited the quantity of ink which would be stored in an ink tank of a given size, increasing the frequency of ink tank replacement.

A prior art ink jet printer in which an ink containing unit and an ink jet recording head are mounted on a carriage is disclosed in European Patent Publication No. 581,531. In the disclosed printer, in order to prevent printing failures caused by variation of the ink level or air bubbles due to movement of the ink cartridge, which is caused by the movement of the carriage, the ink container is divided into two regions. A first region of the container adjacent the recording head houses ink impregnated in a porous member, and a second region contains liquid ink without a porous member. This structure enables the ink to be conducted to the recording head via the porous member so that the problems arising from movement of the ink in the cartridge are prevented from occurring to a certain extent.

The porous member is held in fluid communication with the recording head by a projecting member which is inserted through a hole formed in the side portion of the container. However, such a structure cannot be applied to a recording head in which air bubbles must be stopped from entering a pressurized chamber, such as that for an ink jet printer in which a piezoelectric vibrator is used as an actuator for ink ejection.

Accordingly, a ink jet printer which solves the above-mentioned problems is derived.

SUMMARY OF THE INVENTION

Generally speaking, in accordance with the present invention, there is provided an ink-supplied printer head. Ink is supplied to the printer head by an ink supply system, including an ink tank having an ink supply port and a pair of side walls. An ink absorbing member which occupies less than the total volume of the ink tank is contained therein adjacent the ink supply port.

More specifically an ink cartridge is formed of a ink chamber for storing ink and a foam chamber for receiving a porous member for absorbing ink. A partition separates the ink chamber from the foam chamber and has a hole therein so that the foam chamber is in fluid communication with the ink chamber. The ink cartridge is also formed with an ink supply port in the bottom wall of the foam chamber. The ink supply port can include an ink receiving and transmitting member which extends into the tank and locally compresses the ink absorbing member.

Accordingly, it is an object of the invention to provide an improved ink cartridge for an ink jet printer.

It is an object of the present invention to provide a high-quality and highly reliable ink-supplied printer head of a simple construction which is capable of supplying a stable and appropriate quantity of ink from an ink tank to the printer head.

Still other objects, features and advantages of the present invention will become more apparent from the following description when taken in conjunction with the accompanying drawings in which preferred embodiments of the present invention are shown by way of illustrative example and not in a limiting sense.

The invention accordingly comprises the several steps and relation of one or more of such steps with respect to each of the others, and the apparatus embodying features of construction, combinations of elements and arrangement of parts which are adopted to effect such steps, all as exemplified in the following detailed disclosure, and the scope of the invention will be indicated in the claims.

BRIEF DESCRIPTION OF THE DRAWINGS

For a full understanding of the invention, reference is had to the following description taken in connection with the accompanying drawings, in which:

FIG. 16(*b*) is a top plan view showing the lid with a seal affixed thereto;

FIG. 17(*b*) is a cross-sectional view of the packing member prior to insertion;

DESCRIPTION OF THE PREFERRED EMBODIMENTS

A printer head according to the present invention may be used in four-color printer plotter or color image printer and has four-color ink systems and wires or ink jets corresponding respectively to four ink colors. The four-color printer plotter employs black, red, green and blue inks, and moves the head or a sheet of print paper or both and then projects a wire, or ejects ink without the use of a projecting wire as in a conventional ink jet print head, corresponding to a desired one of the colors against the print paper at a prescribed position thereon to form an ink dot. Desired characters and figures can thus be recorded by repeating the above cycle. The present invention is applicable to ink jet printers of all varieties, including print heads using heat from heated resistors or the like or the displacement of piezoelectric or with transducers to project a drop of ink from a chamber upon application of a print signal. The ink supply tanks according to the invention can supply ink continuously to said chambers through capillary paths.

In a color image printer using inks of four colors, that is, black, red, green and blue, a sheet of print paper is scanned by a printer head in a direction perpendicular to the direction of feed of the print paper to form one-dot line in one scanning stroke, and the print paper is fed along by line pitches to record images. In seven-color printers, inks of four colors, that is, black, yellow, magenta and cyan, are used, and the colors of red, green and blue are formed on a sheet of print paper by superimposing inks of two out of the three desired colors other than black, thereby recording color images of seven colors.

The present invention is concerned primarily with the printer head, and in particular with the ink tanks, and detailed description of the overall printer construction will be given only by way of a single example.

Figure 1:
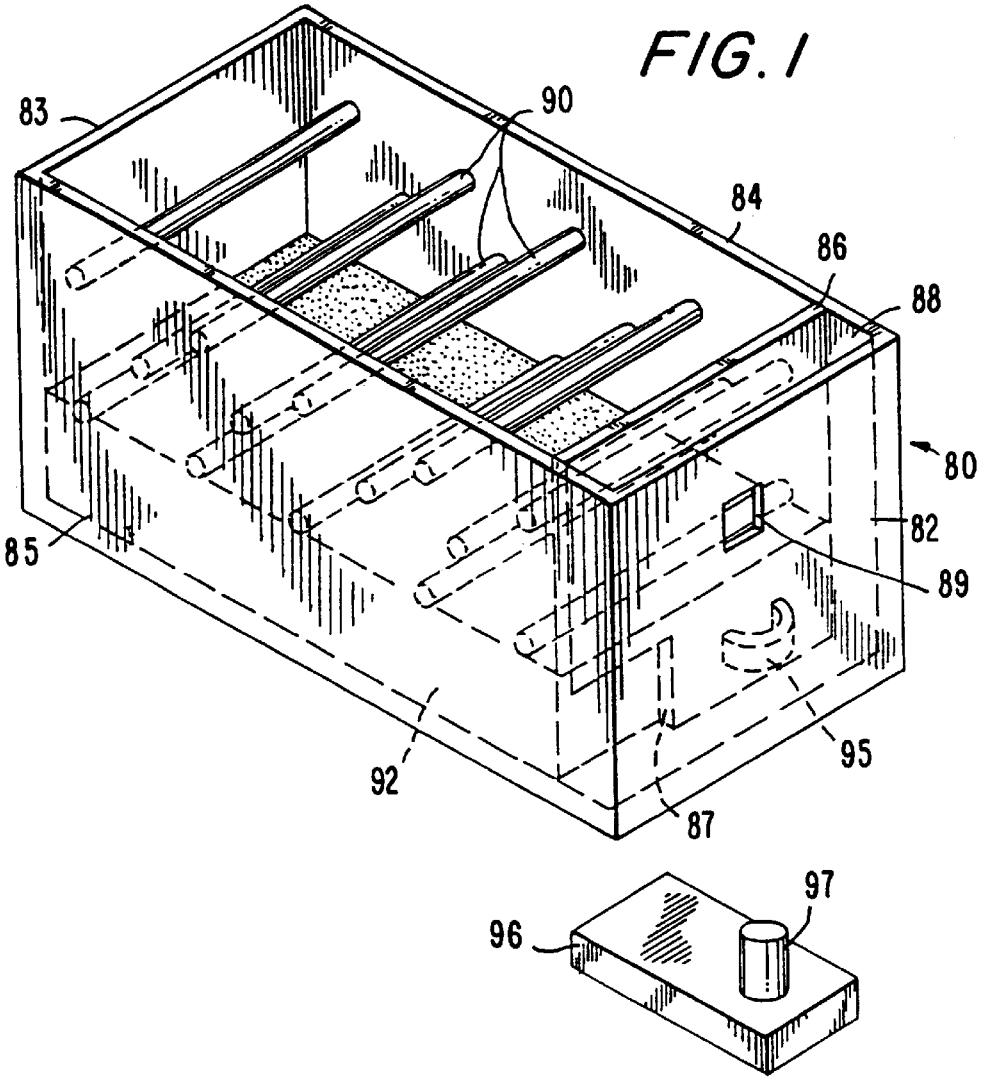
FIG. 1 is a perspective view of an ink tank according to a first embodiment of the present invention with the cover removed, shown exploded from an ink jet print head.
Figure 2:
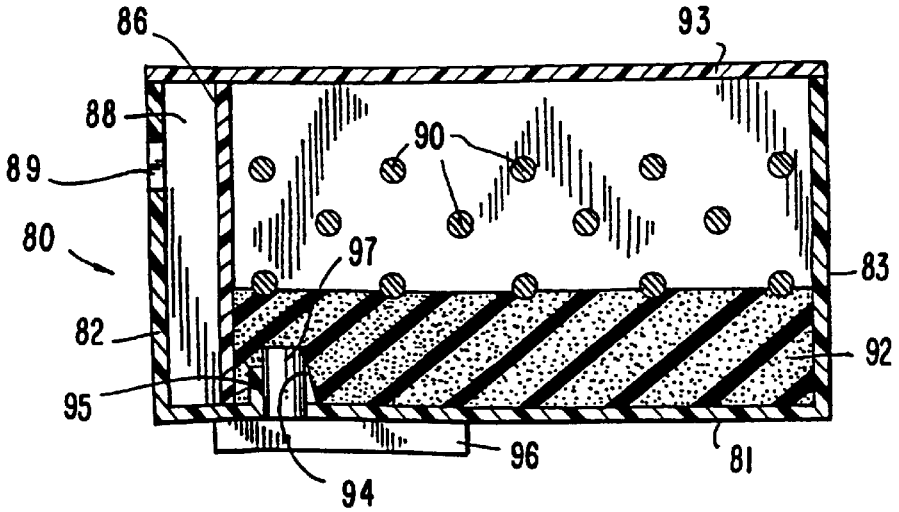
FIG. 2 is a cross-sectional view of the ink tank of FIG. 1.

FIGS. 1 and 2 depict an ink tank 80 according to an alternative embodiment of the present invention. Ink tank 80 is formed of bottom wall 81 (FIG. 2), a lid or cover 93 (FIG. 13) (removed in FIG. 1), end walls 82 and 83, side walls 84 and 85, and internal partition wall 86. Side walls 84 and 85 may be formed of a transparent material to allow the user to more easily determine the quantity of ink remaining in ink tank 80. An opening 94 is formed in the bottom wall 81 of tank 80 and a guide wall 95 extends into the interior of tank 80 partially extending about the opening. Ink absorbing member 92 is placed in the portion of ink tank 80, defined by side walls 84 and 85, end wall 83, partition wall 86 and the lower row of support rods 90, filling approximately less than half of the total internal volume of tank body 80.

A plurality of support rods 90 extend in three staggered rows between the internal surfaces of side walls 84 and 85 within ink tank 80.

In this embodiment, support rods 90 are used in place of a second ink absorbing member of greater porosity, with the added benefit that the volume of tank body 80 available for holding ink is increased. Support rods 90 also insure that side walls 84 and 85 do not deform upon application of increased pressure, providing increased structural integrity to the ink tank.

An ink jet print head 96 is provided with an ink receiving and transmitting member 97 which is received in opening 94 of bottom wall 81 of ink tank 80, so that the end thereof, defining an ink port, engages the ink absorbing member 92. As is shown in FIG. 2 at least a portion (the bottom row in this embodiment) of support rods 90 are located in contact with ink absorbing member 92, especially in close proximity to where ink opening 94 is located. Thus, at least one of support rods 90 acts as a resistance mechanism against the compressive force imparted to ink absorbing member 92 by ink receiving and transmitting member 97 and serve to position the ink absorbing member 92 in a lower portion of the ink tank 80. Ink receiving and transmitting member 97 projects from the plane of bottom wall 81 from a location closer to partition wall 86 of ink tank 80 than to end wall 83. This location aids in insuring compression as desired in the region of the ink absorbing member facing the ink port. Such compression aids in delivering ink to the ink port and aids in preventing air bubbles, if any, from reaching the ink port.

Partition wall 86 is formed with a cut-out portion 87 below the level of ink absorbing member 92 communicating with an ambient air compartment 88. Thus, ink absorbing member 92 covers substantially all of cut-out portion 87. Compartment 88 is defined by partition wall 86, end wall 82, lid 93, and the right ends of side walls 84 and 85 as viewed in FIG. 1. End wall 82 is formed with an air vent port 89 above the level of ink absorbing member 92, exposing compartment 88 to ambient air.

In use, ink tank 80 would preferably be filled with ink under low pressure conditions so that ink absorbing member 92 is filled with ink and is essentially free of air bubbles, and the portion of ink tank 80 between ink absorbing member 92, lid 93, end wall 83, partition wall 86 and side walls 84 and 85 is filled with liquid ink. Support rods 90 serve the additional purpose of dampening the flow of ink within the space above ink absorbing member 92 when the ink tank is displaced during printing. In the usual case, the ink tank is mounted on a print head and carriage for oscillatory motion. In any event, since the ink absorbing member extends along the entire bottom of the chamber defined in the ink tank above the ink absorbing member, ink will tend to remain in contact with the ink absorbing member to replenish it even if the carriage moves during printing.

Figure 3:
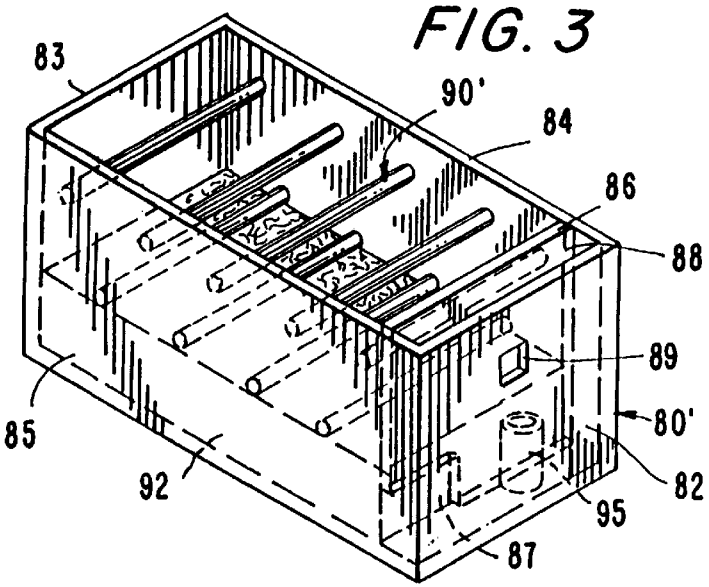
FIG. 3 is a perspective view of an ink tank with the cover removed according to a still further embodiment of the present invention.
Figure 4:
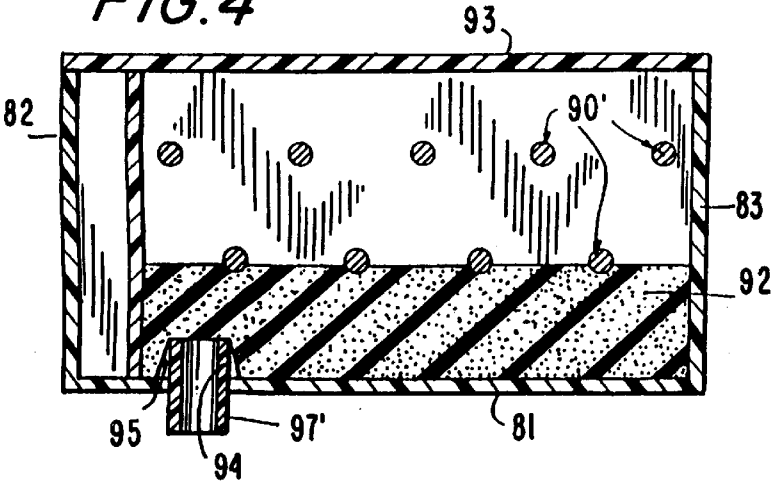
FIG. 4 is a side cross-sectional view of the ink tank of FIG. 3.

FIGS. 3 and 4 depict an ink tank according to a second alternative embodiment of the present invention. In this embodiment, all parts and functions of ink tank 80' are essentially similar to those in the previous embodiment, like reference numerals being used for like elements, except that the number of support rods 90' is reduced and support rods 90' are repositioned into two rows in order to further increase the volume of ink tank 80 available for the storage of ink. Even with this decreased number of support rods 90', at least one of support rods 90 is placed in close proximity to ink receiving and transmitting member 97', so as to oppose the compressive force imparted upon ink absorbing member 92 by ink receiving and transmitting member 97', as is shown in FIG. 4.

Figure 5:
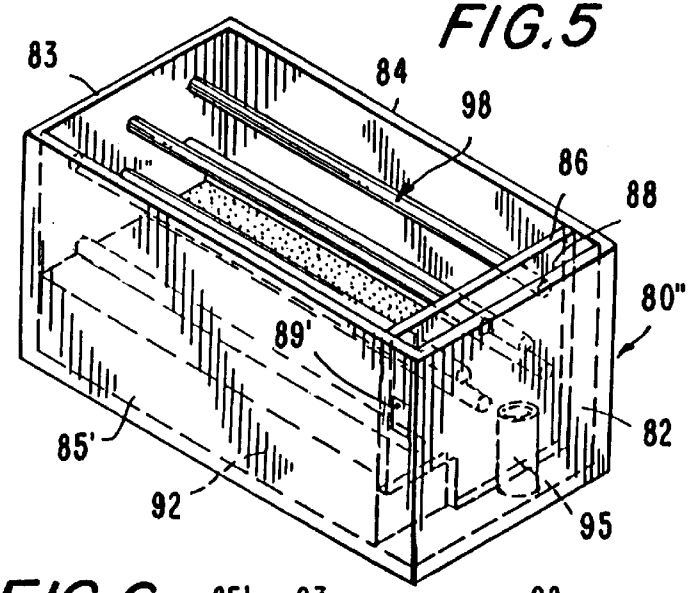
FIG. 5 is a perspective view of an ink tank with the cover removed according to a still further embodiment of the present invention.
Figure 6:
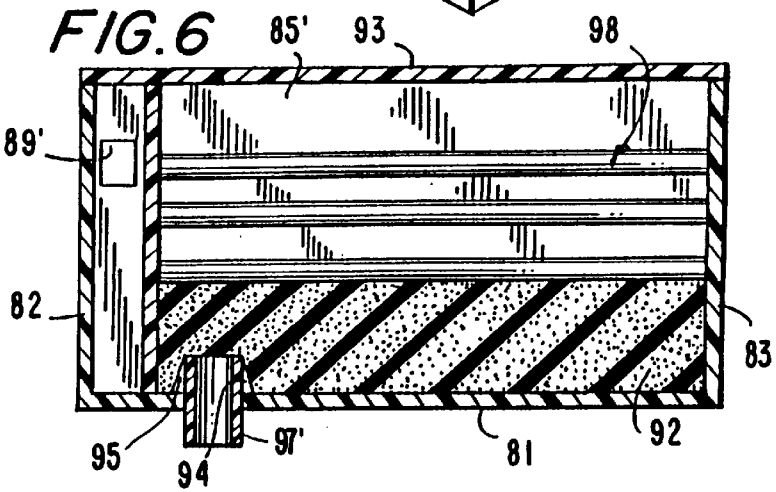
FIG. 6 is a cross-sectional view of the ink tank of FIG. 5.

FIGS. 5 and 6 depict an ink tank 80" according to a third alternative embodiment of the present invention, like reference numerals being used for like elements. This embodiment is similar in structure to the embodiment depicted in FIGS. 1 and 2. In this embodiment, in place of support rods 90 or 90' extending between side walls 84 and 85, long support rods 98 are located above ink absorbing member 92 supported between the internal surfaces of end wall 83 and partition wall 86. As is shown in FIG. 6, air vent hole 890 is located in exterior side wall 85' in the portion which helps define compartment 88. As is seen in FIGS. 1-6 the layer of rods 90'; 98 adjacent the ink absorbing member 92 occupy less than one-half of the surface of the ink absorbing member engaged thereby.

Figure 7:
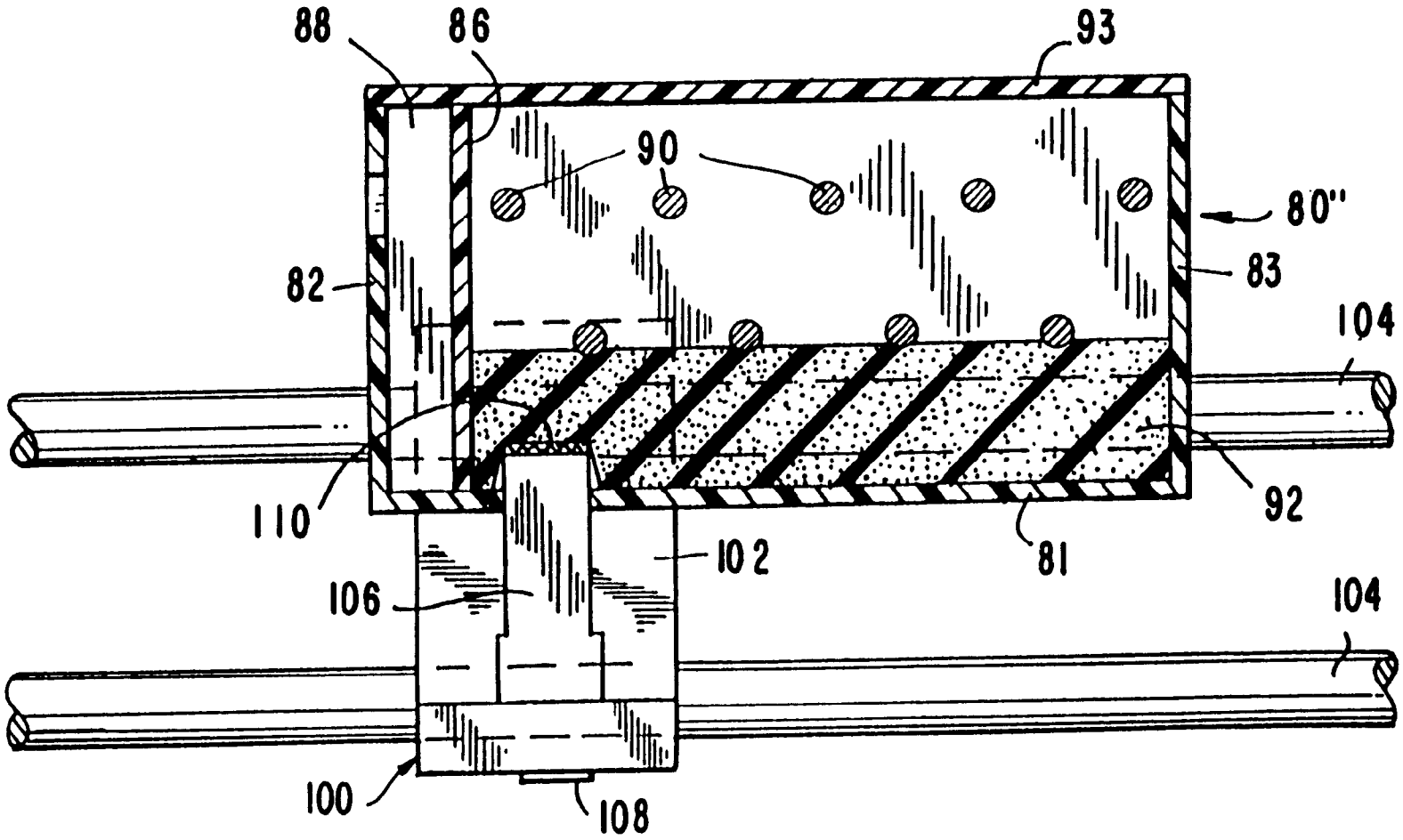
FIG. 7 is a side elevational view of an ink jet type printer of the present invention with the ink supply tank in cross section.

Referring now to FIG. 7, ink tank 80" is shown mounted on an ink jet print head 100, which is in turn mounted on a carriage 102, which itself is mounted on support beams 104 for reciprocal displacement relative to a print medium (not shown). Print head 100 would include an ink receiving and transmitting member 106 for receiving ink from ink tank 80" and delivering such ink by capillary action to the operative mechanism of the ink jet print head. The ink jet print head is also provided with an output nozzle array 108 for applying the ink to an ink medium (not shown) which can be displaced in the direction normal to the longitudinal direction of support beams 104 to permit print on an entire sheet of the print media. A mesh filter 110 is provided at the end of ink transmitting and receiving member 106 to filter the ink received from the ink absorbing member.

According to the preferred embodiments of the ink tank depicted in FIGS. 1–7, the upper portion of the ink tank will not be filled with a porous member 61. Rather, the upper portion of the ink tank will be filled with ink and support rods 90, 90' or 98. As a result, ink will not move from porous member 61 to 62, but rather will move from the portion of the tank containing the liquid ink and support rods 90, 90' or long support rods 98 into porous member 92.

Figure 8:
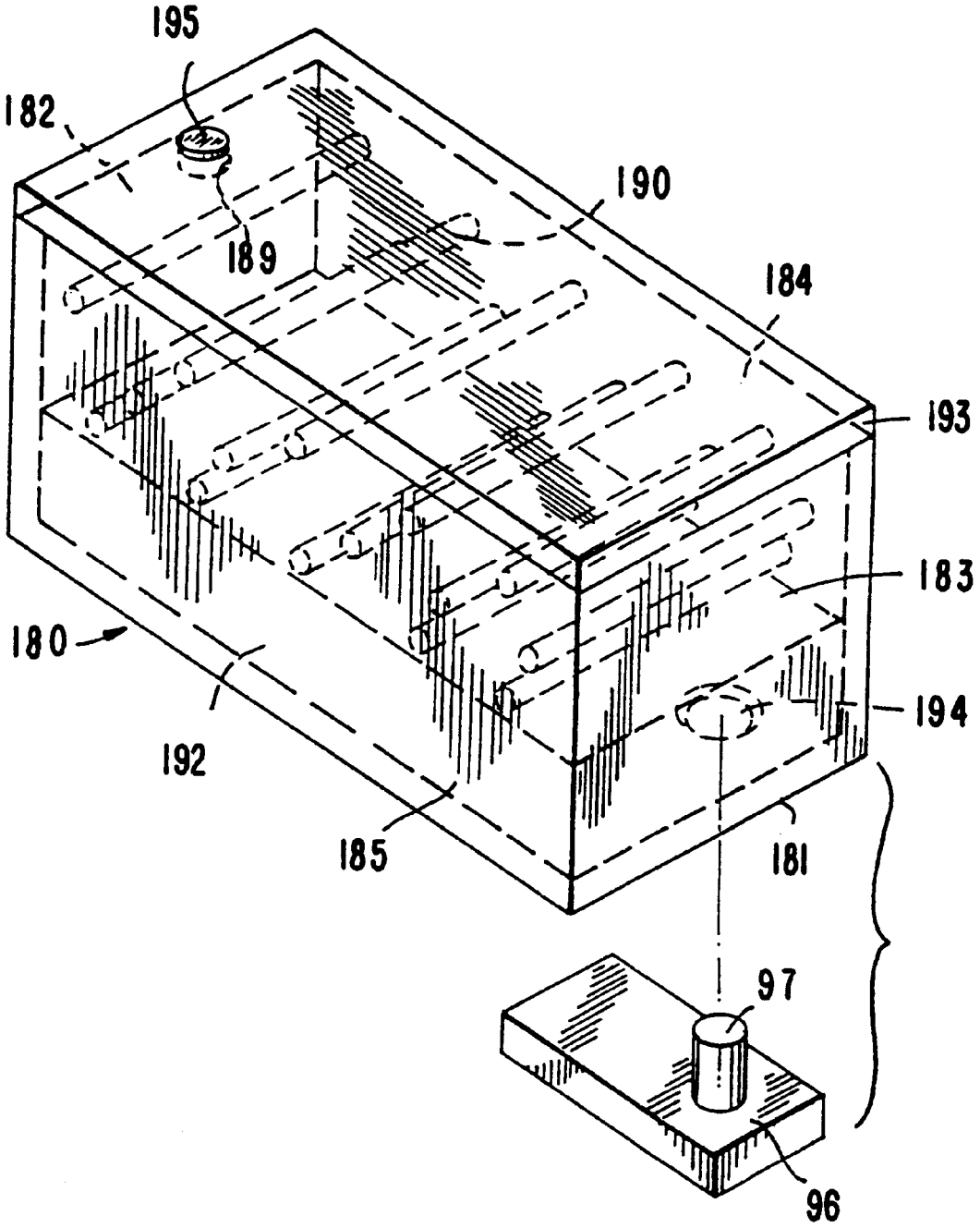
FIG. 8 is a perspective view of an ink tank according to still another embodiment of the present invention shown exploded from an ink jet print head.

FIG. 8 differs from the embodiment of FIG. 1 principally by the elimination of partition wall 86 and in the design of the air vent. In addition, FIG. 8 depicts an ink tank 180 according to still another embodiment of the present invention. Ink tank 180 is formed with bottom wall 181, a lid or cover 193, end walls 182 and 183, and side walls 184 and 185. Side walls 184 and 185 may be formed of transparent material to allow the user to more easily determine the quantity of ink remaining in ink tank 180. An opening 194 is formed in the bottom wall 181 of tank 180. Ink absorbing member 192 is placed in the portion of ink tank 180, defined by side walls 184 and 185, and end walls 182 and 183, and a lower row of support rods 190, filling approximately less than half of the total internal volume of tank body 180.

A plurality of support rods 190 extend in three staggered rows between the internal surfaces of side walls 184 and 185 within ink tank 180.

In this embodiment, support rods 190 are used in place of a second ink absorbing member of greater porosity, such as ink absorbing member 61 of FIG. 4, with the added benefit that the volume of tank body 180 available for holding ink is increased. Support rods 190 also insure that side walls 184 and 185 do not deform upon application of increased pressure, providing increased structural integrity to the ink tank.

An ink jet print head 96 is provided with an ink receiving and transmitting member 97 which is received in opening 194 of bottom wall 181 of ink tank 180, so that the end thereof, defining an ink port, engages the ink absorbing member 192. At least a portion (the bottom row in this embodiment) of support rods 190 are located in contact with ink absorbing member 192, especially in close proximity to where ink opening 194 is located. Thus, at least one of support rods 190 acts as a resistance mechanism against the compressive force imparted to ink absorbing member 192 by ink receiving and transmitting member 97 and serves to position the ink absorbing member 92 in a lower portion of the ink tank 80. Ink receiving and transmitting member 97 projects from the plane of bottom wall 181 from a location closer to end wall 183 of ink tank 180 than to end wall 182. This location aids in insuring compression as desired in the region of the ink absorbing member facing the ink port. Such compression aids in delivering ink to the ink port and aids in preventing air bubbles, if any, from reaching the ink port.

Lid 193 is formed with an air vent port 189 formed therein. A plug member 195 is provided in air vent port 189. Plug member 195 is formed of a material which renders the plug member air permeable, but not permeable to ink or other liquids.

In use, ink tank 180 would preferably be filled with ink under low pressure conditions so that ink absorbing member 192 is filled with ink and is essentially free of air bubbles, and the portion of ink tank 180 between ink absorbing member 192, lid 193, end walls 182 and 183, and side walls 84 and 85 is filled with liquid ink. Support rods 190 serve the additional purpose of dampening the flow of ink within the space above ink absorbing member 192 when the ink tank is displaced during printing. In the usual case, the ink tank is mounted on a print head and carriage for oscillatory motion. In any event, since the ink absorbing member extends along the entire bottom of the chamber defined in the ink tank above the ink absorbing member, ink will tend to remain in contact with the ink absorbing member to replenish it even if the carriage moves during printing.

In a manner similar to FIG. 8, the embodiments of FIGS. 3–7 could likewise be made without a partition wall.

Figure 11:
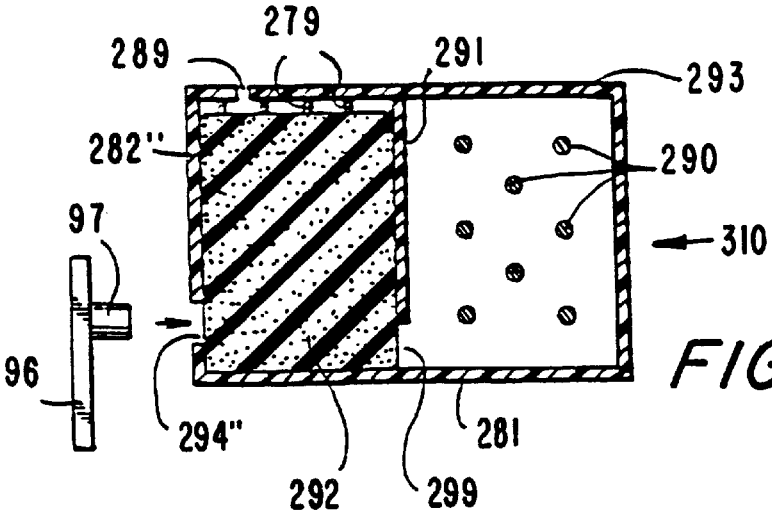
FIG. 11 is a cross sectional view of an ink tank according to a further embodiment of the present invention.
Figure 9:
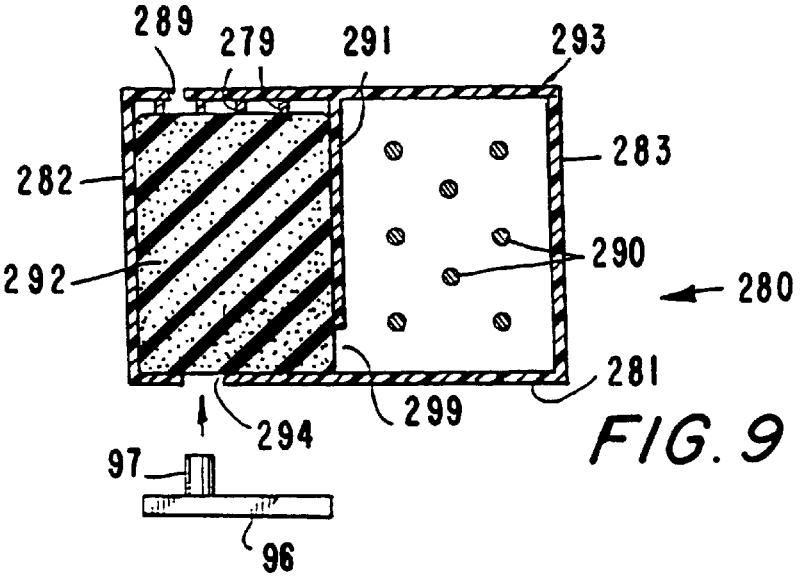
FIG. 9 is a cross-sectional view of an ink tank according to a still further embodiment of the present invention.
Figure 10:
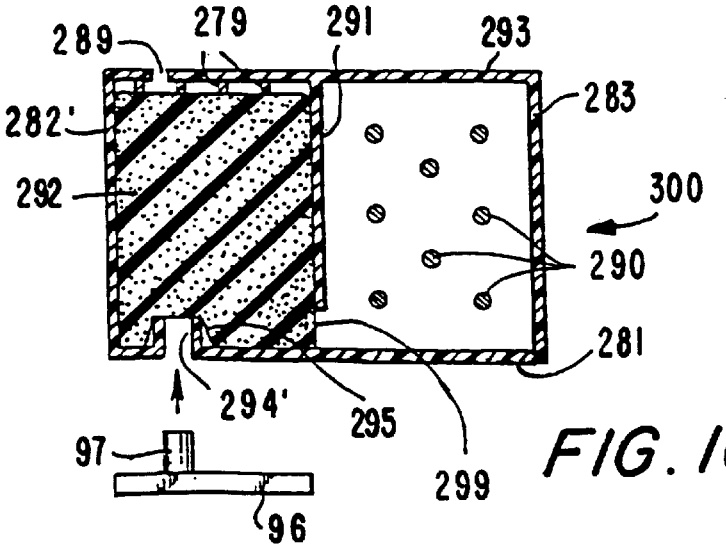
FIG. 10 is a cross-sectional view of an ink tank according to a further embodiment of the present invention.

FIGS. 9–11 depict ink tanks according to additional alternative embodiments of the present invention. As is depicted in FIG. 9, ink tank 280 is formed with bottom wall 281, a lid or cover 293, end walls 282 and 283, and side walls (not shown in FIG. 20). The side walls 284 and 285 (not shown) may be formed of a transparent material to allow the user to more easily determine the quantity of ink remaining in ink tank 280. An opening 294 is formed in the bottom wall 281 of ink tank 280. A partition wall 291 extends vertically intermediate end walls 282 and 283 from cover 293 to define two chambers formed by communicating passage 299 defined between the lower edge of partition wall 293 and bottom wall 281. Ink-absorbing member 292 is disposed in the chamber defined by the portion of ink-supply tank 280 between end wall 282 and partition wall 291. Support rods 290 are disposed in the chamber defined by the portion of ink-supply tank 280 between partition wall 291 and end wall 283. An air vent port 289 is formed in lid 293 positioned to be in registration with the chamber of ink tank 280 containing ink-absorbing member 292. A plurality of projections 279 are formed on the underside of lid 293 in the chamber of ink tank 280 containing ink-absorbing member 292.

An ink jet print head 96 is provided with an ink receiving and transmitting member 97 which is received in opening 294 of bottom wall 281 of ink tank 280, so that the end thereof, defining an ink port, engages ink absorbing member 292. Ink receiving and transmitting member 97 projects from the plane of bottom wall 281 from a location in the portion of ink tank 280 containing ink-absorbing member 292. This location aids in insuring compression as desired in the region of the ink-absorbing member facing the ink port. Such compression aids in delivering ink to the ink port and aids in preventing air bubbles, if any, from reaching the ink port.

In use, ink tank 280 would preferably be filled with ink under low pressure conditions so that ink absorbing member 292 is filled with ink and is essentially free of air bubbles, and the portion of ink tank 280 containing support rods 290 is filled with liquid ink. In addition to providing additional structural support to ink tank 280, support rods 290 serve the additional purpose of dampening the flow of ink within the space aside ink absorbing member 292 when the ink tank is displaced during printing. In the usual case, the ink tank is mounted on a print head and carriage for oscillatory motion. In any event, since the ink absorbing member extends along the bottom of the chamber in proximity to the ink port, ink will tend to remain in contact with the ink absorbing member to replenish it even if the carriage moves during printing.

FIG. 10 depicts an ink tank 300 according to an additional alternative embodiment of the present invention, like reference numerals being used for like elements. This embodiment is similar in structure to the embodiment depicted in FIG. 9. In this embodiment, an opening 294' is formed in the bottom wall 281' of ink tank 300, and a guide wall 295' extends into the interior of tank partially extending about opening 294'. This guide wall further aids in local compression of ink-absorbing member 292.

FIG. 11 depicts an ink tank 310 according to an additional alternative embodiment of the present invention, like reference numerals being used for like elements. This embodiment is similar in structure to the embodiments depicted in FIGS. 9 and 10. In this embodiment, an opening 294" is formed in end wall 282" of ink tank 310. An ink jet print head 96 is provided with an ink receiving and transmitting member 97 which is received in opening 294" of end wall 282" of ink tank 310, so that the end thereof, defining an ink port, engages ink absorbing member 292. Ink receiving and transmitting member 97 projects from the plane of end wall 282" from a location in the portion of ink tank 300 containing ink-absorbing member 292. This location aids in insuring compression as desired in the region of the ink-absorbing member facing the ink port. Such compression aids in delivering ink to the ink port and aids in preventing air bubbles, if any, from reaching the ink port.

Operation of the ink supply tank of the embodiments of FIGS. 9–11 will now be described. Reference will be made specifically to FIG. 9 with the understanding that the embodiments of FIGS. 10 and 11 operate similarly. As ink is consumed from the ink tank 280, the ink level in the chamber between partition wall 291 and side wall 283 falls as ink leaves that chamber and is absorbed in ink-absorbing member 292. When the chamber between partition wall 291 and side wall 283 is essentially empty, the ink level will then be reduced in the area of the ink absorbing member away from ink port 294 in that the ink will be carried toward ink port 294 through capillary action. Ambient air from air vent 289 passes through ink absorbing member 292 and communicating passage 299 into the chamber between partition wall 291 and side wall 283.

When the ink tank runs short of ink, and the ink in the tank is rendered highly viscous by being dried at high temperature, or is solidified and thus failing to supply ink, a cartridge ink tank can be mounted in place so that fresh ink can immediately be supplied to the print head for resuming desired printing operation.

According to the printer head of the present invention, no ink flow interruption occurs due to variations in temperature and atmospheric pressure and a uniform ink density is produced. Unintentional ink flow out of the ink tank is avoided, thus avoiding smearing the print paper with the undesired ink spots. Ink will not enter the printer head mechanism, preventing malfunctioning. The cartridge ink tank can easily be detached and attached for ink replenishment.

Figure 12:
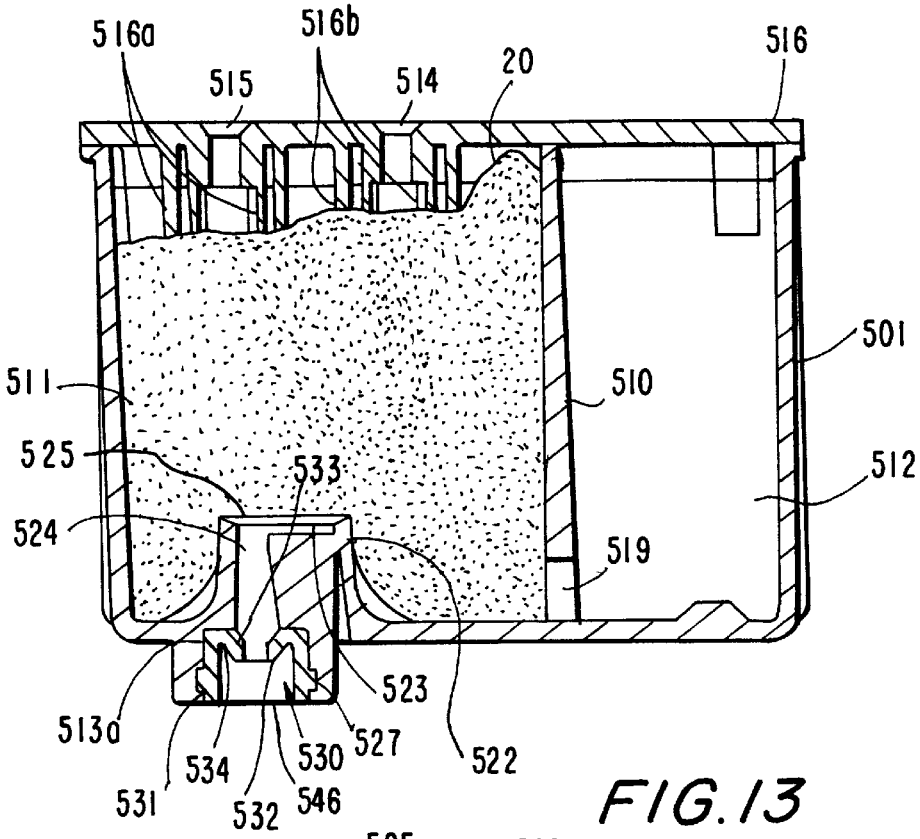
FIG. 12 is a cross-sectional view of a multi-color ink jet printer cartridge constructed in accordance a first additional embodiment of the invention.
Figure 13:
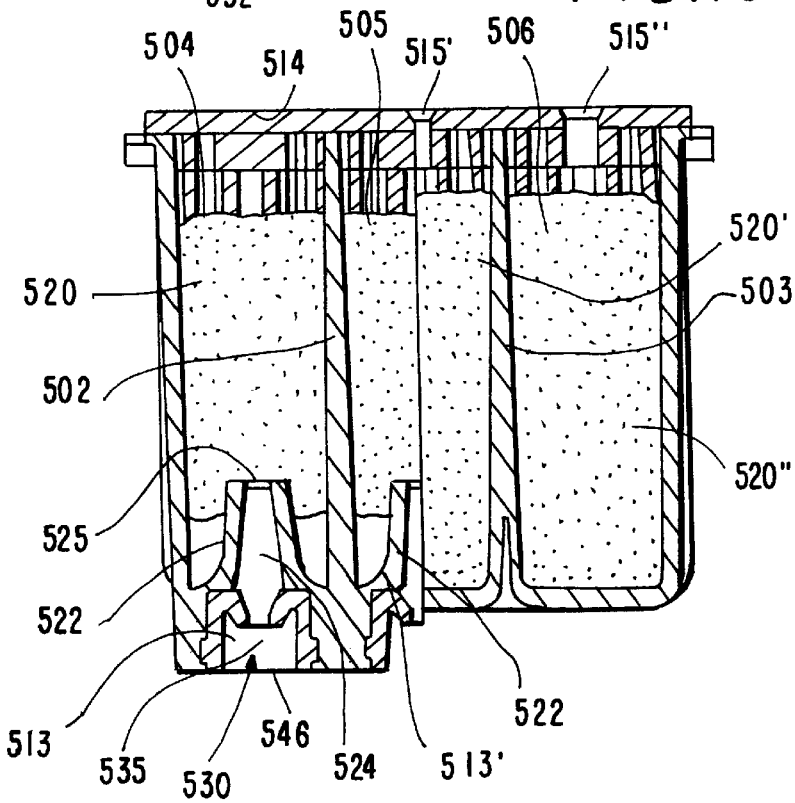
FIG. 13 is a cross-sectional view of the first additional embodiment rotated 90° from the view in FIG. 12.

The ink cartridge is also configured so as to be mounted with a small force and with accommodating a misalignment of a certain degree. Reference is first made to FIGS. 12 and 13 which depict an ink cartridge constructed in accordance with a first additional embodiment of the invention. A main container 501, is divided into three compartments 504, 505, and 506 by partitions 502 and 503 as shown in FIG. 13. Each of the three compartments 504, 505, and 506 is divided by a center partition wall 510 into foam chambers 511, 511' or 511" housing a respective porous member 520, 520' or 520" and ink chambers 512, 512' or 512" which are adapted to contain liquid ink. Foam chambers 511, 511', 511" are dimensioned to receive a respective porous member 520, 520' 520".

The volume of each of porous members 520, 520' and 520" is selected so as to be larger than the capacity of each of the respective foam chambers 511, 511' or 511", so as to be compressed while being retained in the respective foam chamber in a preferred embodiment. The ratio of the capacities of each foam chamber 511, 511' or 511" and each ink chamber 512, 512' or 512" is selected so that each foam chamber 511, 511' or 511" is dimensioned to hold 20 to 30% more ink than the respective ink chamber 512, 512' or 512".

Figure 14:
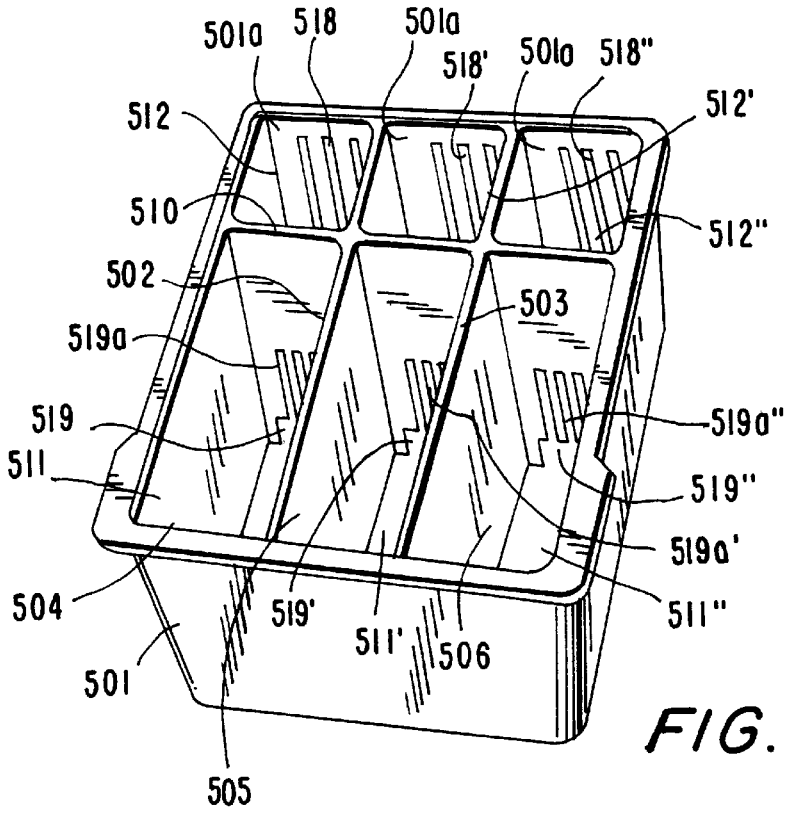
FIG. 14 is a perspective view showing the ink cartridge of FIGS. 12 and 13 with the lid removed.

When inks of three colors are contained within a single cartridge as in FIGS. 12–14, it may be difficult to see if different amounts of ink remain in the chambers, which may be caused by unbalanced consumption of the different color inks. When ink of one color is depleted, and the user wishes to dispose of the cartridge, the user need not unnecessarily worry about any remaining ink of the other colors in the cartridge leaking. When a cartridge of the invention is disposed of, ink is prevented from flowing out of the cartridge because ink of each color is absorbed by each respective porous member, thereby protecting the environment from any leakage of ink.

Ink supply ports 513, 513' and 513" (not shown), chamber 511 being exemplary of each chamber 511, 511' and 511", are formed in main container 501 within a respective foam chamber 511, 511', 511". Each ink supply port 513, 513' and 513" is adapted to engage with a respective ink supply needle (not shown) of the recording head which are inserted at the lower end of each of the foam chambers 511, 511' and 511".

Figure 16A:
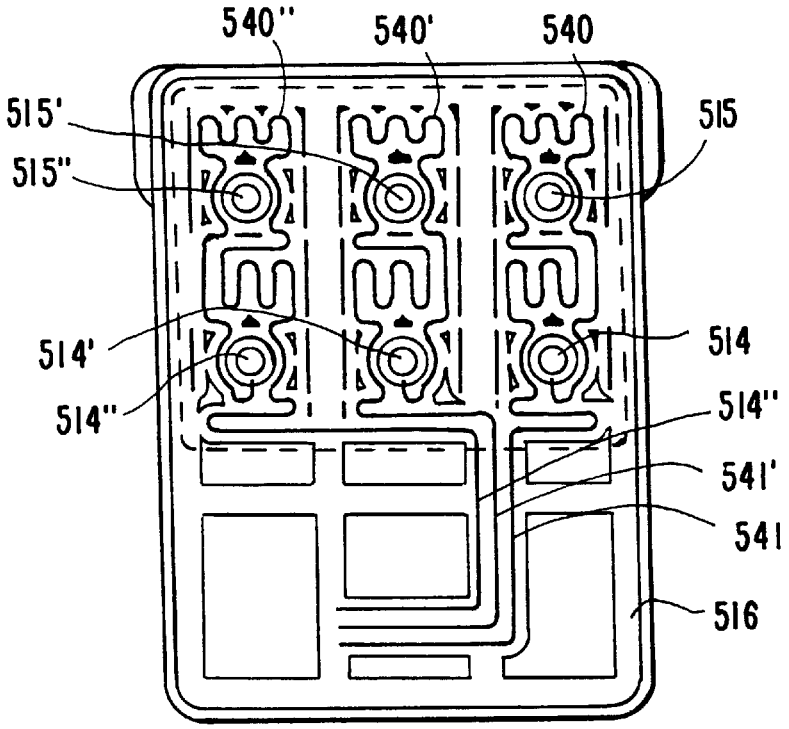
FIG. 16(*a*) is a top plan view of the lid of FIG. 12.

Referring now to FIGS. 12 and 13, the upper end of the main container 501 is sealed by a lid 516. Two ink filling ports 514 and 515 are formed at positions on lid 516 corresponding to foam chamber 511. Similarly, as shown in FIG. 16(a), each chamber 511, 511' and 511" includes corresponding ink filling ports 514 and 515, 514' and 515', and 514" and 515". Projections 516*a* and 516*b*, FIG. 12, are integrally formed with the inner surface of lid 516 and are positioned in foam chamber 511, so as to surround filling ports 515 and 514, respectively. Porous member 520 is compressed by projections 516*a* and 516*b* against the bottom wall of foam chamber 511 in which ink supply port 513 is formed. Projections 516*a'* and 516*b'*, and 516*a"* and 516*b"* are similarly formed in the inner wall of lid 516, and are positioned in foam chambers 511' and 511", which contain ink supply ports 513' and 513", respectively as shown in FIG. 13.

Projection 516*a* which opposes ink supply port 513 is formed with its lower tip located at a position lower than the lower tip of projection 516*b*, whereby the portion of porous member 520 in the vicinity of ink supply port 513 is compressed to the greatest extent.

Protrusion portions 522, 522' and 522" (collectively "522"), which cooperate with lid 516 to compress porous members 520, 520' and 520" respectively are formed on the bottom of each of foam chambers 511, 511' and 511". Recesses 523, 523' and 523" (collectively "523"), which define spaces having a fixed opening area, are formed at the upper end of respective protrusion portions 522. Through holes 524, 524' and 524" (collectively "524") are disposed within the respective protrusion portions 522. One end of each through hole 524 is in fluid communication with the spaces defined by recesses 523 and the other end with a respective packing (collectively "530"), which will be hereinafter described. Filters 525, 525' and 525" (not shown) (collectively "525") are fixed to the upper end of recesses 523 respectively.

Packing members 530 of which only 530 is shown, are disposed at the lower end of ink supply ports 513, 513' and 513" respectively and are made of a resilient material such as rubber. Packing members 530, are configured as a funnel-shaped packing which opens upward. The lower ends of tubular portions 531 are thicker than the other portions. The respective upper peripheral edges 533 of taper portions 532 of respective packing members 530 contact with step portions 513*a* of respective ink supply ports 513, 513' and 513". Each packing member 530 is formed with protrusions 535 received by stepped portion 527 within the inner wall of ink supply port 513. The boundary between tubular portions 531 and taper portions 532, are configured as thin connection portions 534.

In this design, packing members 530 are fixed by tubular portions 531 to respective ink supply ports 513. Additionally, upward movement of upper peripheral edges 533 is prevented by respective step portions 513*a*. Thus, even when the respective ink supply needle is inserted or extracted, packing members 530 are adequately fixed to ink supply ports 513. Since taper portions 532 serve to attain the hermetic seal between the packing member of the respective ink supply port 513 and the ink supply needle by the respective thin connection portions 534, the taper portions can be moved somewhat without causing deformation. Consequently, the air tight seal between the respective packing member and ink supply needle can be maintained while accommodating a relative misalignment between the respective ink supply needle and ink supply port.

Communicating holes 519, 519' and 519" are formed in center partition wall 510, which separates foam chambers 511, 511' and 511" from ink chambers 512, 512' and 512" respectively. Slots 519*a*, 519*a'* 519*a"* which extend to a predetermined height are formed to be in communication with communicating holes 519, 519' and 519" respectively for gas-liquid replacement. Between each respective pair of foam and ink chambers 511 and 512, 511' and 512', and 511" and 512", porous members 520, 520' and 520" are housed in the foam chambers 511, 511' and 511" respectively in such a manner that each porous member is held against the respective communicating hole 519, 519' or 519". Ribs 518, 518', and 518" are formed on a back wall 501*a* of container 501 within a respective ink chamber 512, 512' and 512". An individual communication hole is formed between each respective chamber pair 511, 512, and extend along only a portion of the length of partition 510 formed thereat.

Figure 15:
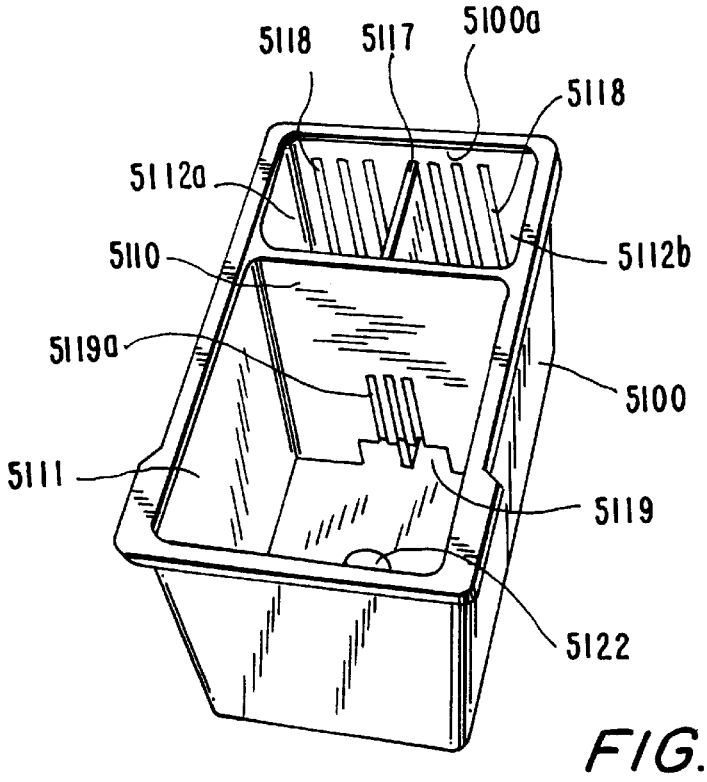
FIG. 15 is a perspective view showing a single color ink cartridge constructed in accordance with a second additional embodiment of the invention.

In a second additional embodiment of the invention an ink cartridge is utilized for a single color ink. A cartridge 5100 for a single color, or black ink can be made smaller in size than that for color inks, but the ink chamber 5112 for black ink would have a larger capacity than each of the corresponding chambers for a color ink. According to the second additional embodiment of the invention, a cartridge for black ink is shown in FIG. 15 having a partition wall 5117 formed within a container 5100 so as to extend between center partition wall 5110 which separates a foam chamber 5111 from a ink chamber 5112 and a side wall 5100*a* of main container 5100, thereby dividing ink chamber 5112 into two cells 5112*a* and 5112*b*. This structure prevents container 5100 from being deformed by a negative pressure produced during the ink filling process which will be hereinafter described, or by an external pressure during usage, thereby preventing any ink from leaking. Cells 5112*a* and 5112*b* are retained in fluid communication with foam chamber 5111 via a communicating hole 5119 in center partition 5110 which extends along only a portion of the length of partition 5110. In addition, a communicating hole may be formed in the lower portion of partition wall 5117.

On the inner face of wall 5100*a*, which can easily be seen when the cartridge is mounted on a carriage, a plurality of ribs 5118 are formed which extend vertically along inner face 5100*a*. These ribs allow ink to flow more easily down along wall 5100*a*, and the user can easily recognize the amount of ink remaining in the cartridge by seeing the ink level.

Figure 16B:
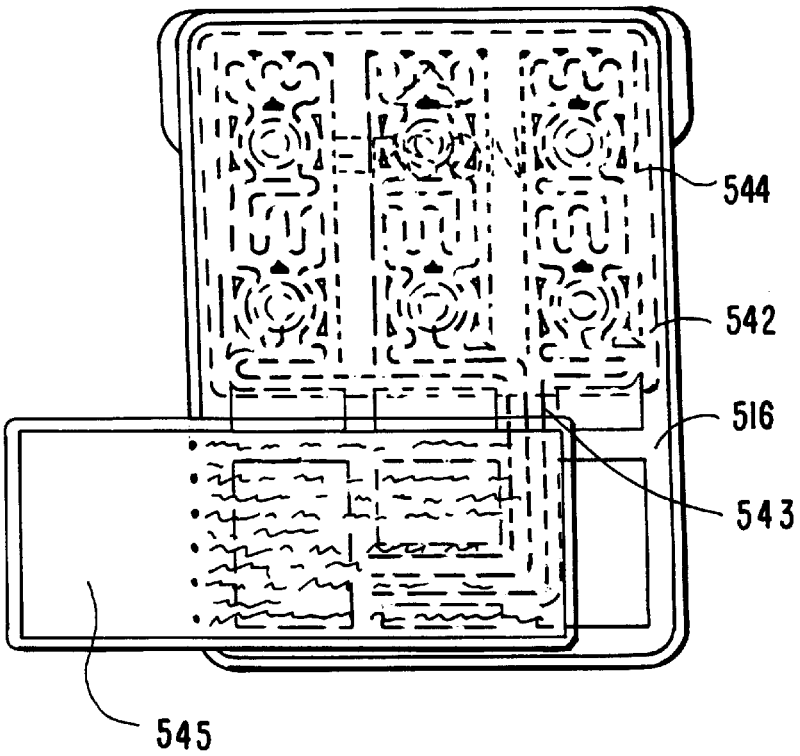

Reference is now made to FIGS. 16(*a*) and 16(*b*) which depict lid 516 constructed in accordance with the first additional embodiment of the invention. Ink filling holes 514, 514' and 514", and 515, 515' and 515" are formed in the regions of lid 516 corresponding to the placement of porous members 520, 520' and 520" within container 501. Air communicating ports 541, 541' and 541" are connected to ink filling holes 514, 514' and 514" via grooves 540, 540' and 540", respectively.

When a seal 542 for covering ink filling holes 514, 514' and 514", 515, 515' and 515", and air vent ports 541, 541' and 541" is fixed to the top surface of lid 516, FIG. 16(*b*), after ink compartments 511, 511' and 511" are filled, grooves 540, 540' and 540" form capillary tubes with seal 542. A tongue piece 545 of seal 542, which protrudes from lid 516, is formed with a neck portion 543 disposed in seal 542 at a midpoint of the route of air vent ports 541, 541' and 541". When tongue piece 545 is peeled from lid 516, tongue piece 545 is easily separated from seal 542. This in turn exposes air vent ports 541, but no other portions of the underside of seal 542.

In a preferred embodiment, seal 542 is formed with patterns such as characters and illustrations printed on its main portion 544 which permanently seals grooves 540, 540' and 540". Patterns, colors, or other printing different from that printed on main portion 544 of seal 542 may be placed on tongue piece 545 which is connected to main portion 544 of seal 542 via neck portion 543.

For example, in a further preferred embodiment, the main portion 544 of seal 542 has a blue background, black characters and other illustrations printed thereon. The background color of tongue piece 545 is a color such as yellow or red which contrasts with the background color of main portion 544. Characters and illustrations are printed on the background in colors which are mainly black or blue. In this way, main portion 544 and tongue piece 545 are distinguished from each other in color and pattern. Consequently, it is possible to call the user's attention to the need for the removal of tongue piece 545.

Each of ink supply ports 513, 513' and 513" are sealed by a film 546 (FIG. 12), and ink filling needles are hermetically inserted into the ink filling holes 514, 514' and 514" and 515, 515' and 515" respectively. The first of filling holes 514, 514' and 514" is connected to evacuating means, and the second of the filling holes 515, 515' and 515" is closed.

The evacuating means reduces the pressure in each of foam chambers 511, 511' and 511" and in each of ink chambers 512, 512' and 512". When the pressure is reduced to a predetermined value, the evacuating operation is stopped and the first filling hole is closed. Thereafter, the second filling hole is placed in fluid communication with a measuring tube filled with ink. Ink contained in the measuring tube is drawn into the evacuated container and is then absorbed by respective porous member 520, 520' and 520" and thereafter flows into ink chamber 512, 512' or 512" via communicating holes 519, 519' or 519" respectively.

After the specified amount of ink flows into the appropriate ink chamber, seal 542 is fixed to the outer surface of lid 516 so that the ink filling holes 514, 514' and 514" and 515, 515' and 515", grooves 540, 540' and 540", and communicating ports 541, 541' and 541" are sealed under reduced pressure. Seal 542 thereafter maintains the reduced pressure states of foam chambers 511, 511' and 511" and ink chambers 512, 512' and 512".

Before use of the cartridge, tongue piece 545 of seal 542 is then peeled off so that tongue piece 545 is broken at neck portion 543 and is separated from main portion 544. Thus, ink filling holes 514, 514' and 514" are placed in fluid communication with air vent ports 541, 541' and 541" via grooves 540, 540' and 540". Also, foam chambers 511, 511' and 511" are placed in fluid communication with air vent ports 541, 541' and 541" and therefore ambient air, via grooves 540, 540' and 540". Thus, while the ink is prevented from evaporating, the ink cartridge is ventilated.

Figure 17A:
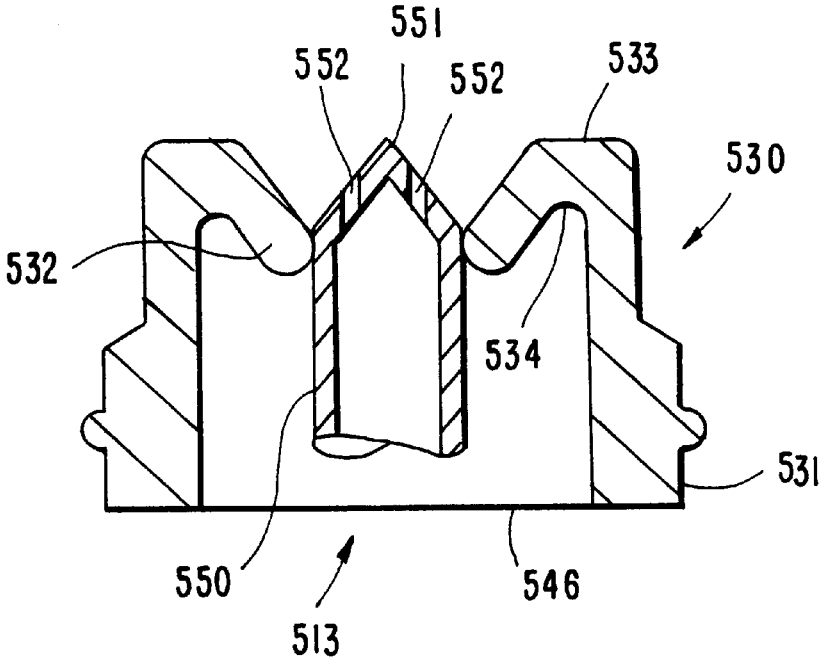
FIG. 17(*a*) is a cross-sectional view showing a packing member with an ink supply needle inserted therein in accordance with the invention.
Figure 17B:
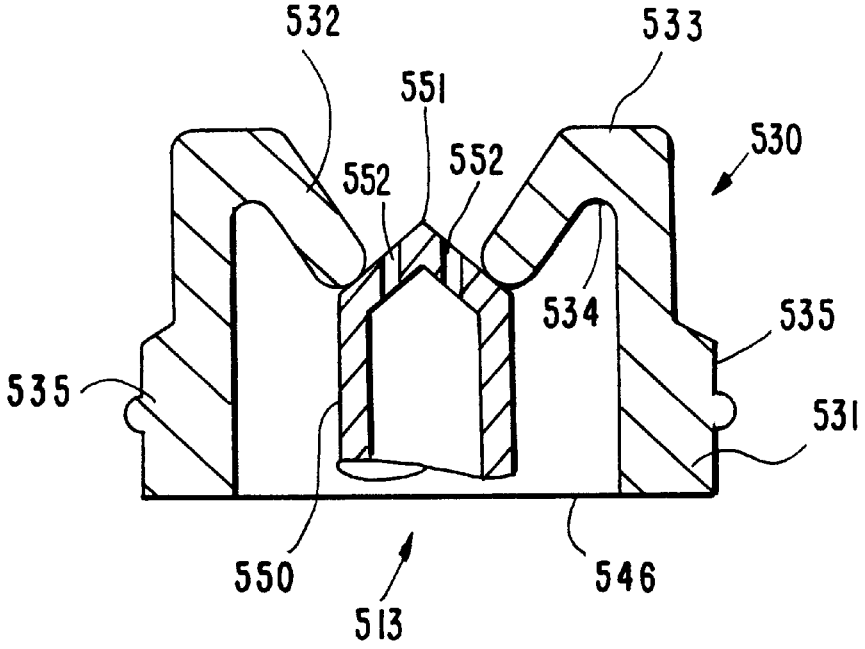

Reference is now made to FIGS. 17(*a*) and 17(*b*), wherein an ink supply port 513 of the ink cartridge is positioned so as to be aligned with an ink supply needle 550 of the recording head. Thereafter the ink cartridge is pushed toward the recording head upon insertion of the ink cartridge. A taper portion 551 of ink supply needle 550 passes through a film seal 546 and engages the hole of packing member 530 as shown in FIG. 17(*a*). Since packing member 530 opens upward and the open portion tapers upward, packing member 530 allows ink supply needle 550 to pass therethrough while packing member 530 is resiliently deformed by taper portion 551 of ink supply needle 550.

When the cartridge is used, ink supply needle 550 passes through packing member 530. The resiliency of connection portion 534 of packing member 530 enables taper portion 532 to engage ink supply needle 550. Even if ink supply needle 550 of the recording head and the center of packing 530 are somewhat misaligned, ink supply port 513 and ink supply needle 550 are hermetically sealed.

To conduct ink into the recording head after the ink cartridge is mounted, or to recover the ink ejection function of the recording head, a negative pressure is applied to the recording head and through ink supply needle 550 so that ink in the cartridge flows through ink supply needle 550 and into the recording head. Because of the pressure difference, this high negative pressure applied to the cartridge causes taper portion 532 of packing member 530, which hermetically seals and isolates the cartridge from ambient air, to deform upward in FIG. 17(*a*) toward the interior of the ink cartridge. Thus, the pressure difference aids in causing taper portion 532 of packing member 530 to be resiliently pressed against ink supply needle 550, and thereby aids in hermetically sealing the ink cartridge.

Even if ink supply needle 550 is not positioned completely through packing member 530, the resilient force in taper portion 532 of packing member 530 allows taper portion 532 to remain in contact with ink supply needle 550 as long as the tapered portion 551 of ink supply needle 550 remains in contact with taper portion 532 as shown in FIG. 17(*b*). Consequently, it is possible to secure the air tightness of packing member 530 and ink supply needle 550 even if the needle is not properly inserted.

Since the tip of ink supply needle 550 is sealed upon contact with packing member 530, the dead space in the cartridge can be made very small, and any air bubbles which may be produced by the piston effect upon insertion of the cartridge onto the recording head are prevented from entering the cartridge.

When a negative pressure is applied from the nozzle openings of the recording head, ink absorbed by porous member 520 flows into the recording head via through hole 524 and through holes 552 of ink supply needle 550. When ink of a predetermined amount is consumed from porous member 520 and the ink level in porous member 520 is reduced, the pressure of ink chamber 512 overcomes the holding force of porous member 520 in the vicinity of communicating hole 519, so that air bubbles enter ink chamber 512 via communicating hole 519. Consequently, the pressure in a ink chamber 512 is increased and ink therefore flows into a foam chamber 511.

The ink flowing into foam chamber 511 is absorbed by porous member 520 and causes the ink level in foam chamber 511 to be raised. At the instant when the ink holding force of porous member 520 in the vicinity of communicating hole 519 is balanced with the pressure in ink chamber 512, the flow of ink from ink chamber 512 into foam chamber 511 is stopped.

Figure 18:
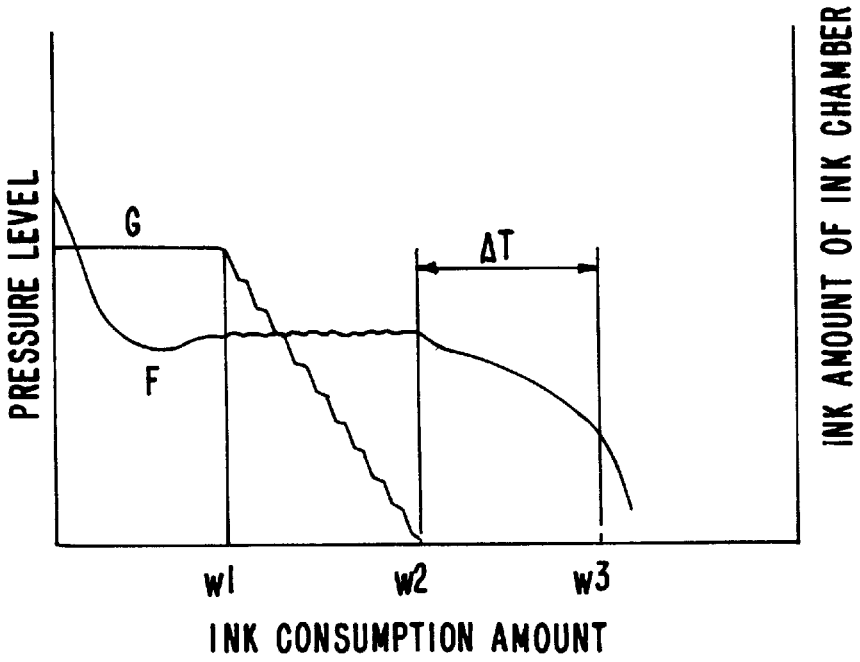
FIG. 18 is a graph showing the relationships of the ink consumption, the ink level, and the amount of ink remaining in an ink chamber.

The graph of FIG. 18 illustrates this process. In the figure, the letter F indicates the pressure level in porous member 520 of foam chamber 511, and the letter G indicates the ink level in ink chamber 512. When a predetermined amount of ink w1 which was initially contained in porous member 520 is consumed so that the ink level in porous member 520 is reduced to a predetermined value at which the pressure in ink chamber 512 overcomes the ink holding force of porous member 520 in the vicinity of communicating hole 519, ink gradually flows in a stepwise manner from ink chamber 512 into the foam chamber 511. This process occurs until the balance between the pressure of the ink chamber 512 and the ink holding force of porous member 520 in the vicinity of communicating hole 519 is restored. As a result, although the ink level in ink chamber 512 is gradually reduced, the ink level in porous member 520 can be maintained at a substantially constant level so that ink is supplied to the recording head by a constant pressure difference at a constant rate.

After a predetermined amount of ink w2 is consumed by the recording head, no ink will remain in ink chamber 512, but the amount of ink contained in porous member 520 will be at a level equal to the level when ink was intermittently being supplied to foam chamber 511 from ink chamber 512. Therefore, printing can be continued using the amount of ink absorbed in porous member 520, although no further ink is available in ink chamber 512 to replenish the ink supply into porous member 520. After a predetermined amount of ink w3 is consumed during printing, the ink supply in porous member 520 will be depleted, and the ink cartridge will no longer support printing.

During the entire printing operation from when all the ink contained in ink chamber 512 is absorbed in porous member 520 until the ink is depleted, a constant amount of ink is supplied to the recording head. The depletion of ink from ink chamber 512 indicates the impending depletion of ink in the ink tank cartridge. If a fresh cartridge is inserted at this stage, it is possible to ensure a constant supply of ink to the recording head without interruption.

As described above, the inner space of the ink cartridge of the invention must be maintained at a negative pressure during the printing process. In addition to the achievement of the above-described hermetic seal between the ink supply port and the ink supply needle, the transfer of ink from ink chamber 512 to the foam chamber 511 must be performed properly to ensure a constant flow of ink to the recording head. Hereinafter, the structure for controlling the supply of ink from ink chamber 512 to foam chamber 511 will be described.

Figure 19:
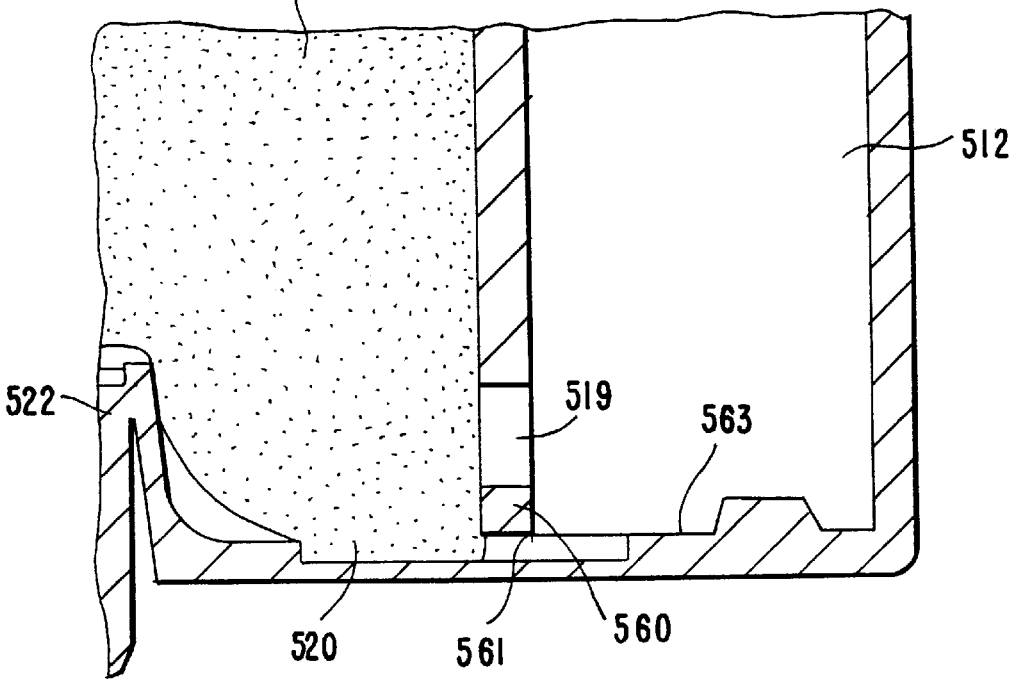
FIG. 19 is a partial cross-sectional view of the ink cartridge showing the boundary between ink and foam chambers in accordance with a third additional embodiment of the invention.

Reference is now made to FIG. 19 which depicts the boundary between foam chamber 511 and ink chamber 512 in a third additional embodiment of the invention. Like numerals are utilized to indicate like structures, the primary difference between this embodiment and the first additional embodiment being a step portion formed in hole 519.

A step portion 560 is formed in communicating hole 519. A portion 563 of the base of ink chamber 512 is higher than that of foam chamber 511, step portion 560 being the dividing point. A groove 561 connecting the foam and ink chambers is formed in the lower part of step portion 560.

Porous member 520 is in contact with communicating hole 519 and is received by step portion 560 so that the portion of porous member 520 in the vicinity of communicating hole 519 is compressed, whereby the required pressure difference between ink chamber 512 and foam chamber 511 via communicating hole 519 can be attained. When the ink level of ink chamber 512 is reduced to a low level, groove 561 enables ink from ink chamber 512 to be collected and then absorbed by porous member 520 in foam chamber 511. Consequently, all of the ink in ink chamber 512 can be supplied to the recording head for printing without wasting any ink.

Figure 20:
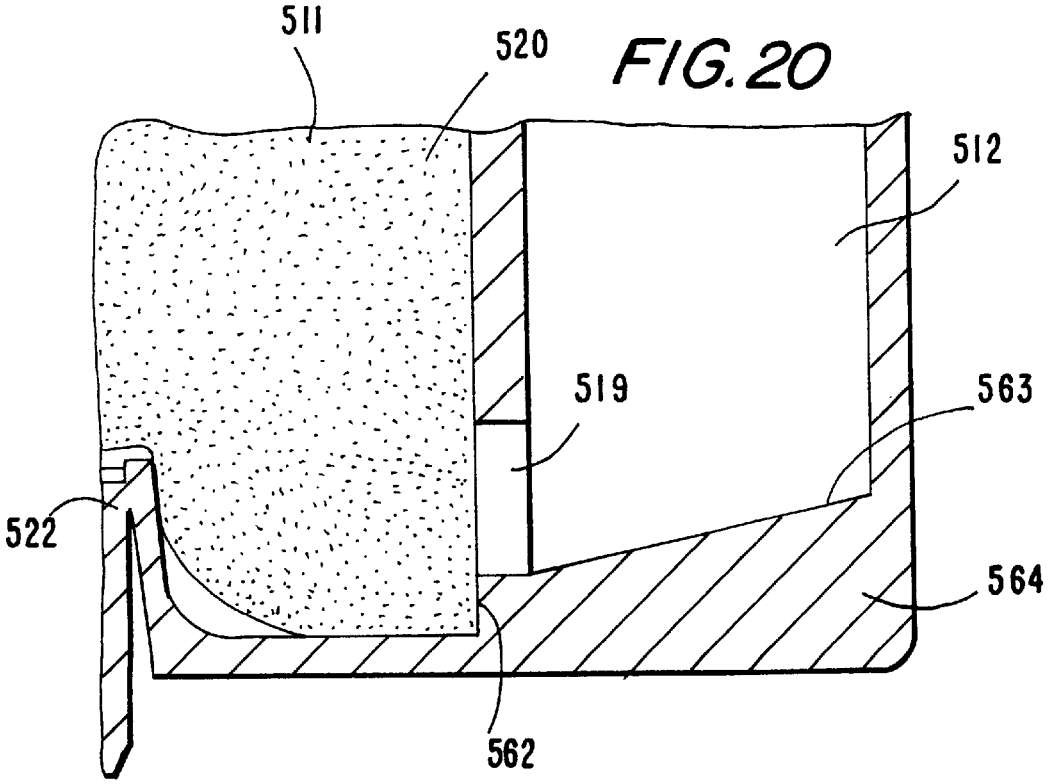
FIG. 20 is a partial cross-sectional view of the ink cartridge showing the boundary between ink and foam chambers in accordance with a fourth additional embodiment of the invention.

Reference is now made to FIG. 20, which depicts an ink cartridge constructed in accordance with a fourth additional embodiment of the invention. Again, like numerals are used to indicate like structures, the primary difference between this embodiment and the first additional embodiment is the different leveled bottoms of the respective chambers.

The bottom face 564 of ink chamber 512 is higher than the bottom face 567 of foam chamber 511, thereby forming a step portion 562. Step portion 562 receives the lower portion of porous member 520 so that the portion of porous member 520 in the vicinity of communicating hole 519 is compressed. When required, a slope 563 which is directed from the ink chamber 512 to the foam chamber 511 may be formed to aid in the supply of ink. Since slope 563 allows ink in ink chamber 512 to flow more easily toward foam chamber 511, irrespective of the inclination of the carriage, ink from ink chamber 512 can be constantly supplied to the recording head.

Figure 21:
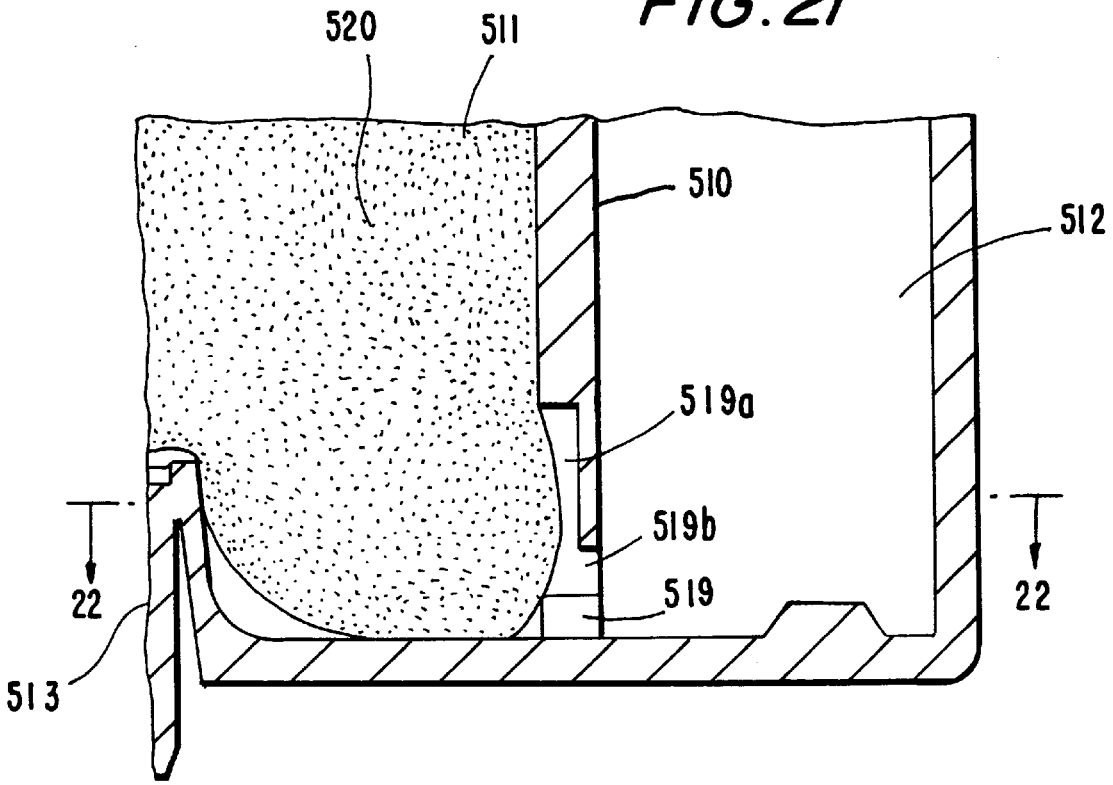
FIG. 21 is a partial cross-sectional view of the boundary between ink and foam chambers of an ink cartridge constructed in accordance with a fifth additional embodiment of the invention.
Figure 22:
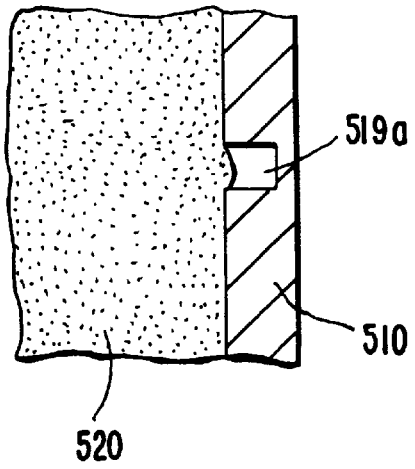
FIG. 22 is a cross-sectional view taken along line 22—22 of FIG. 21.

Reference is now made to FIGS. 21 and 22 which depict an ink jet cartridge constructed in accordance with a fifth additional embodiment of the invention. Like structures are indicated by like reference numerals, the primary difference between this embodiment and the first additional embodiment is the formation of a through hole. This embodiment is the same as the embodiment shown in FIGS. 14 and 15.

Groove 519*a* (FIGS. 14 and 15) is formed in the face of center partition 510 separating foam chamber 511 from ink chamber 512. Groove 519*a* is formed in the face of partition 510 on the side of the foam chamber 511 and is in communication with the upper portion of communicating hole 519 of center partition 510 within the respective chambers 511, 512. In order to allow air to pass from foam chamber 512 to ink chamber 511 and to retain these chambers in fluid communication with each other, a through hole 519*b* is formed in the lower end of the groove 519*a*. Thus, the upper portion of porous member 520 which exhibits a relatively small capillary force is maintained in fluid communication with communicating hole 519 via the space formed by thin groove 519*a*. Therefore, ink can be smoothly replaced with air so that ink in ink chamber 512 constantly flows into foam chamber 511, thereby preventing too much or not enough ink from being supplied.

Figure 23:
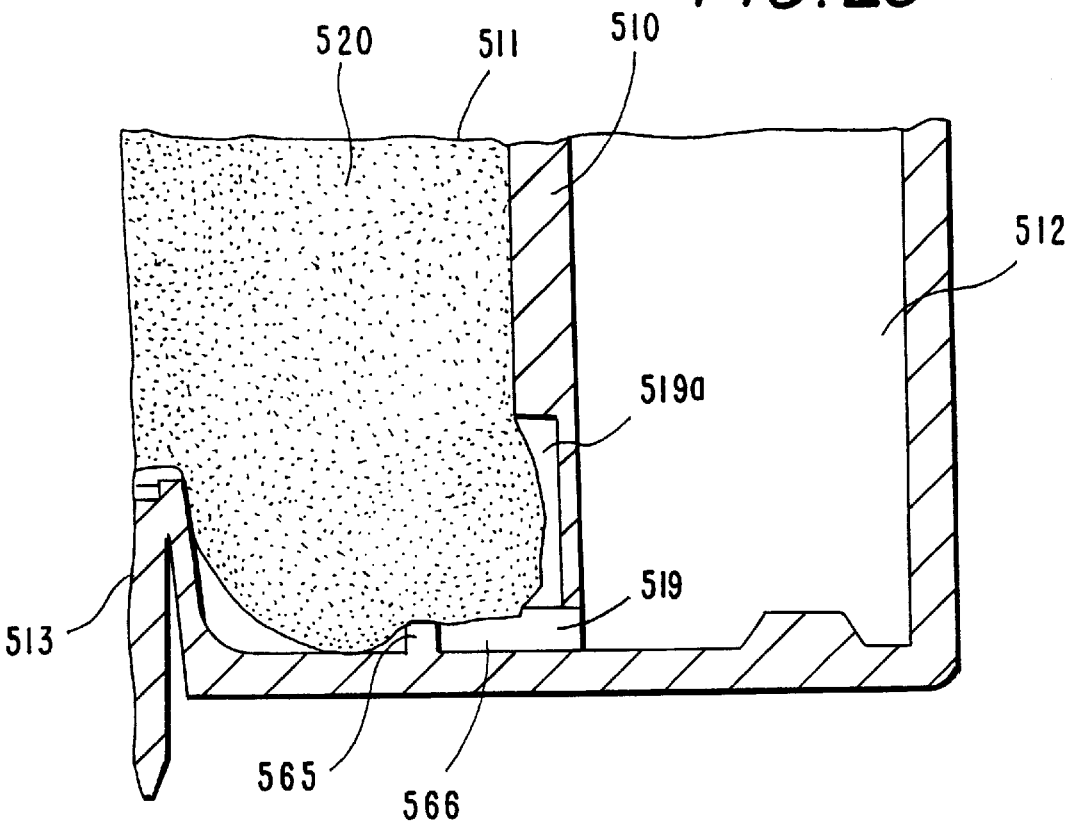
FIG. 23 is a partial cross-sectional view showing the boundary between ink and foam chambers of an ink cartridge constructed in accordance with a sixth additional embodiment of the invention.
Figure 24:
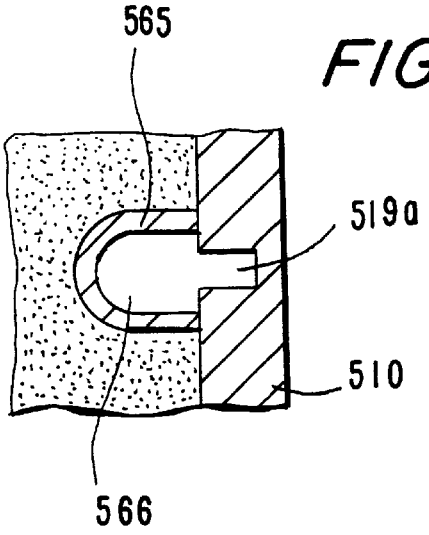
FIG. 24 is a cross-sectional view taken along line 35—35 of FIG. 23.

Reference is now made to FIGS. 23 and 24 which depict an ink cartridge constructed in accordance with a sixth additional embodiment of the invention. Like numerals are utilized to depict like structures, the primary difference being the use of a projection into foam chamber 511.

A horseshoe-shaped projection 565 is formed on the bottom of foam chamber 511 as is shown in FIG. 24. Projection 565 ensures a space in the vicinity of communicating hole 519 so that ink from ink chamber 512 can easily flow into foam chamber 511.

Figure 25:
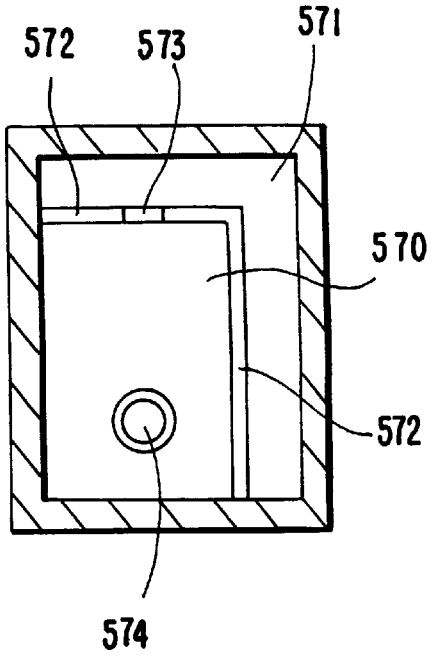
FIG. 25 is a cross-sectional view showing an ink cartridge constructed in accordance with a seventh additional embodiment of the invention.
Figure 26:
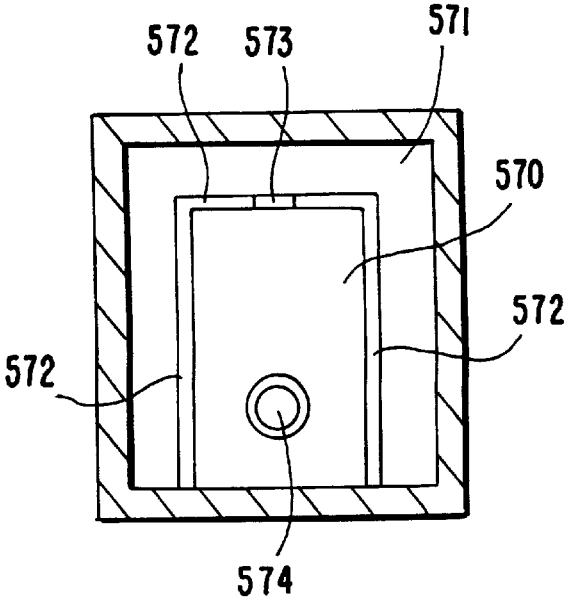
FIG. 26 is a cross-sectional view showing an ink cartridge constructed in accordance with a eighth additional embodiment of the invention.

As described above, foam chamber 511 and ink chamber 512 are separated from each other by the single center partition 510. In seventh or eighth additional embodiments of a single-color ink cartridge, as shown in FIGS. 25 and 26 respectively, an ink chamber 571 may be formed so as to surround two or three sides of a foam chamber 570, and a communicating hole 573 may be formed in at least one of the walls 572 separating the foam chamber 570 from the ink chamber 571. An exit port 574 is positioned within foam chamber 570. An ink cartridge of this design can store an amount of ink which is relatively large as compared with the volume of the whole ink cartridge. Furthermore, because of the location of the chambers, the user can easily see if replacement of the ink cartridge is required because of depletion of the ink.

Figure 27:
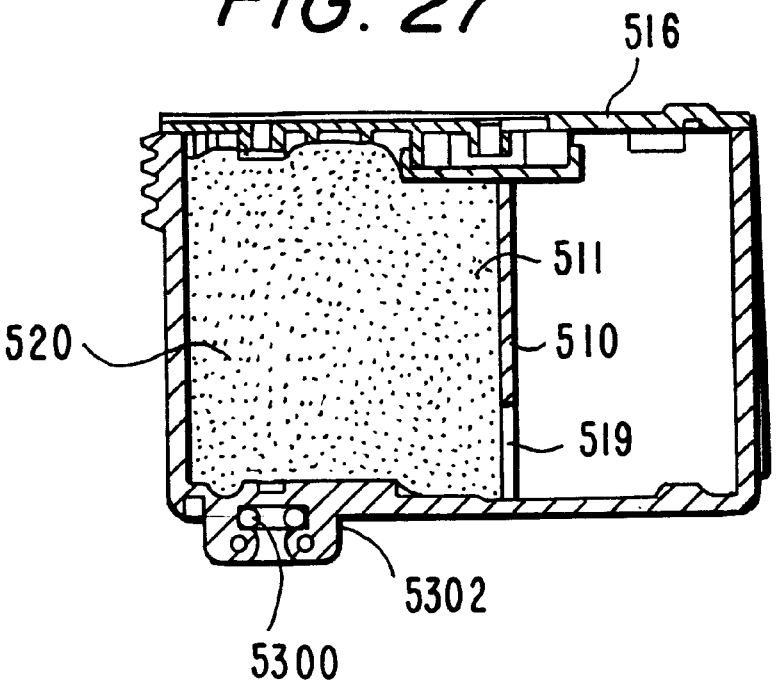
FIG. 27 is a cross-sectional view showing an ink cartridge for an ink jet printer constructed in accordance with a ninth additional embodiment of the invention.
Figure 28:
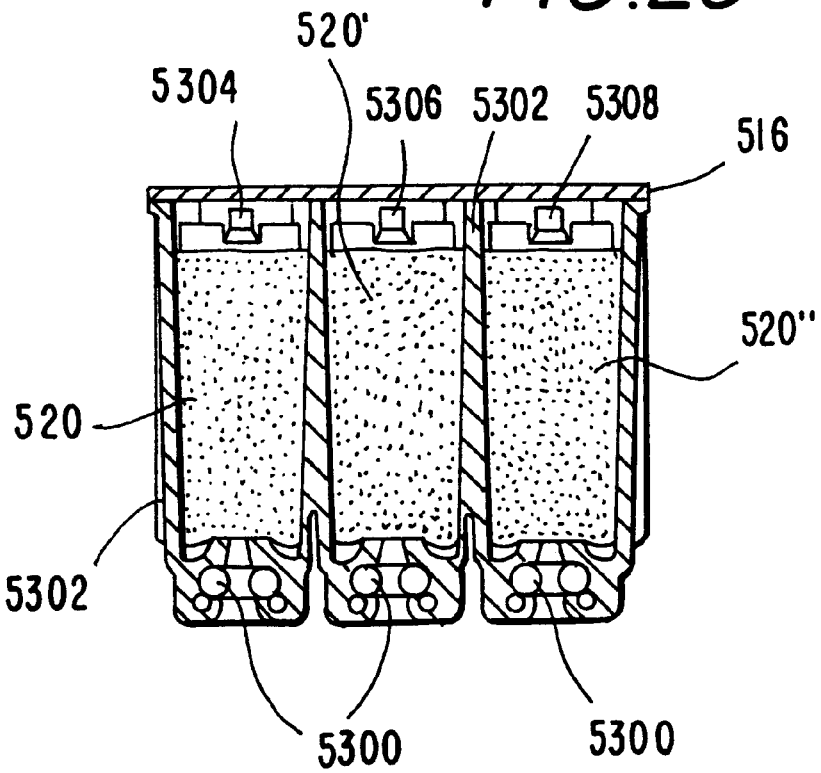
FIG. 28 is a cross-sectional view of the ninth additional embodiment of the invention rotated 90° from FIG. 27.

Reference is now made to FIGS. 27 and 28 wherein an ink jet printer cartridge constructed in accordance with a ninth additional embodiment of the invention is provided. This embodiment is similar to the first additional embodiment, the primary difference being the use of a resilient O-ring 5300 which is retained in contact with the peripheral face of an ink supply needle of the recording head upon insertion of the ink supply needle into the ink supply cartridge. However, this ink jet printer results in other problems solved by the first additional embodiment. A large frictional force may be produced when mounting the cartridge on the carriage and inserting the ink supply needle into the cartridge. This results in an extra strain on the recording head and the carriage. Furthermore, O-ring 5300 is supported at its periphery by the body 5302 of the cartridge. If there is a misalignment between the cartridge and the ink supply needle of the recording head upon insertion of the ink supply needle in the ink supply cartridge, it is very difficult to mount the cartridge. Furthermore, when a three color ink cartridge in which tanks 5304, 5306, and 5308 for the three color inks are integrated into one piece as shown in FIG. 28, it is extremely difficult to mount such a cartridge on the recording head if the cartridge and any of the ink supply needles are misaligned.

It will thus be seen that the objects set forth above, among those made apparent from the preceding description are efficiently attained and, since certain changes may be made in carrying out the above construction and method set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. An ink tank cartridge for an ink-jet type recording apparatus, comprising:

a plurality of first chambers;

a plurality of second chambers, each second chamber being adjacent to and associated with a first chamber;

a plurality of partition walls disposed in said cartridge, each said partition wall being formed with a communicating hole formed therein disposed between said associated chambers, each said communicating hole being positioned in the vicinity of the bottom of said partition wall, each communicating hole essentially defining a plane;

a plurality of ink supply ports, each extending from a bottom wall of a respective one of said plurality of second chambers into a respective one of said second chambers in a direction essentially parallel to said plane defined by said respective communicating hole, said plurality of ink supply ports supplying ink to the exterior of said cartridge, all of said first chambers and associated second chambers being formed as an integral unit;

a respective porous member disposed in each of said second chambers positioned to deliver ink to an associated ink supply port;

an air vent port communicating between each said second chamber and the exterior of said cartridge at a location spaced from said ink supply port and communicating hole; and at least two projections extending from a top wall of each of said second chambers into the respective second chambers and forming an air pocket formed between the associated air vent port and porous member, a first of said projections being of a first height, positioned opposite and facing the associated air supply port, and compressing said porous member against said ink supply port, a second of said projections being of a length less than said first length, positioned between said first projection and the associated partition wall not facing the associated ink supply port, and engaging said porous member.

2. The ink cartridge of claim 1, wherein the porous member associated with each second chamber and the associated first chamber contain ink different from the ink in the other first and second chambers.

3. The ink tank cartridge of claim 1, wherein a pressure balance between each of said first chambers and each of said associated second chambers is maintained by the surface tension of each of said associated porous members in the vicinity of each of said associated communicating holes, each said porous member resiliently contacting said associated communicating hole, said pressure balance maintaining ink in each of said respective first chambers.

4. The ink tank cartridge of claim 3, wherein each said porous member, associated first and second chambers, partition wall, communication hole, ink supply port and air vent port are positioned and dimensioned so that when said ink impregnated in each of said associated porous members is at least partially transmitted through said ink supply port, said pressure balance between said associated chambers is no longer maintained and ink is supplied from the first chamber to the associated porous member in the associated second chamber as required until the pressure balance is restored.

5. The ink tank cartridge of claim 4, further comprising an associated step portion formed at a lower portion of each of said communicating holes, a groove connecting said associated first and second chambers being formed in said ink cartridge below said associated step portion.

6. The ink tank cartridge of claim 4, further comprising a protrusion portion formed on an inner surface of said partition wall in each of said second chambers, each said protrusion portion maintaining a space about said associated communicating hole to aid in the flow of ink therethrough.

7. The ink tank cartridge of claim 4, further comprising a step portion formed below each of said communicating holes.

8. The ink tank cartridge of claim 7, wherein the part of each of said step portions adjacent said associated first chamber is higher than the part adjacent said associated second chamber.

9. The ink tank cartridge of claim 4, further comprising a respective vertically extending thin groove formed in each said partition wall above each communicating hole and on the side of the associated second chambers, each of said grooves being in fluid communication with each associated communicating hole, each of said grooves aiding in the flow of air and ink between said associated first and second chambers.

10. The ink tank cartridge of claim 9, wherein said each of said plurality of ink supply ports extend into said respective one of said plurality of second chambers in a direction essentially parallel to said plane defined by said respective vertically extending thin groove.

11. The ink tank cartridge of claim 4, further comprising a respective vertically extending rib formed on an inner surface of said first chamber, each of said ribs assisting in the flow of ink.

12. The ink tank cartridge of claim 1, further comprising a projection formed on an inside wall of each of said second chambers disposed on a surface of said second chamber opposite said associated ink supply port, said projections compressing said associated porous members against said associated ink supply ports.

13. The ink tank cartridge of claim 12, wherein each said ink supply port includes a portion including its entrance projecting into said second chamber.

14. The ink tank cartridge of claim 12, wherein the volume of each of said porous members before placement in a second chamber is larger than the volume of the associated second chamber in which it is received.

15. The ink tank cartridge of claim 1, wherein the volume of each of said porous members is larger than the capacity of each of said associated second chambers.

16. The ink tank cartridge of claim 1, further comprising at least one chamber partition wall, said chamber partition wall extending substantially perpendicularly from each said partition wall and dividing said first chamber into a plurality of such chambers while permitting communication between each such chamber and the associated second chamber through the associated communicating hole.

17. The ink tank cartridge of claim 1, wherein said first chamber and said second chamber are maintained at a pressure less than atmospheric pressure and said ink cartridge further comprises a plurality of air vent ports formed in a surface of said cartridge, each having an air-impermeable sealing member for selectively sealing said air vent ports when said ink cartridge is not in use and unsealing said air vent ports when said ink cartridge is to be used.

18. The ink tank cartridge of claim 17, wherein each of said air vent ports is formed in part as a groove on the outside surface of a wall of said second chamber and the associated sealing member covering said grooves.

19. The ink tank cartridge of claim 18, wherein said outside surface is of a top lid.

20. The ink tank cartridge of claim 18, wherein said sealing member comprises a main portion, and a tongue piece which is removably connected to said main portion via a neck portion.

21. The ink tank cartridge of claim 20, wherein at least one of different patterns and colors, are printed on said main portion and said tongue piece, said neck portion acting as a boundary between said main portion and said tongue piece.

22. The ink tank cartridge of claim 17, further comprising at least one chamber partition wall extending from each partition, said chamber partition walls dividing each said first chambers into a plurality of sub-chambers.

23. The ink tank cartridge of claim 17, wherein the volume of each of said porous members before placement in a second chamber is larger than the volume of the associated second chamber in which it is received.

24. The ink tank cartridge of claim 17, further comprising a respective vertically extending rib formed on an inner face of each of said first chambers, each of said ribs assisting in the flow of ink.

25. The ink tank cartridge of claim 17, wherein each said air vent port is formed in part as a meandering groove, said sealing member forming at least a portion of said air vent port.

26. The ink tank cartridge of claim 1, wherein the volume of each of said porous members before placement in a second chamber is larger than the volume of the associated second chamber in which it is received.

27. The ink tank cartridge of claim 1 wherein said second chamber is a foam chamber and said first chamber is an ink chamber.

28. The ink tank cartridge above of claim 1, wherein said cartridge is constructed to be removably mounted on said recording apparatus so that one of a plurality of ink supply needles of said apparatus is received in each ink supply port.

29. An ink-jet type recording apparatus for outputting ink onto a recording medium, comprising:

a recording head for ejecting ink; and a multi-color ink tank cartridge removably mountable onto said recording head of said ink-jet type recording apparatus for delivery of ink thereto, said ink tank cartridge, including:

a plurality of first chambers;

a plurality of second chambers, each second chamber being adjacent to and associated with a first chamber;

a plurality of partition walls disposed in said cartridge, each said partition being formed with a communicating hole formed therein disposed between said associated chambers, each said communicating hole being positioned in the vicinity of the bottom of said partition wall, each communicating hole essentially defining a plane;

a plurality of ink supply ports, each extending from a bottom wall of a respective one of said plurality of second chambers into a respective one of said second chambers i a direction essentially parallel to said plane defined by said respective communicating hole, said plurality of ink supply ports supplying ink to the exterior of said cartridge, all of said first chambers being formed as an integral unit;

a respective porous member disposed in each of said second chambers positioned to deliver ink to an associated ink supply port;

an air vent port communicating between each said second chamber and the exterior of said cartridge at a location spaced from said ink supply port and communicating hole; and at least two projections extending from a top wall of each of said second chambers into the respective second chambers and forming an air pocket formed between the associated air vent port and porous member, a first of said projections being of a first height, positioned opposite and facing the associated air supply port, and compressing said porous member against said ink supply port, a second of said projections being of a length less than said first length, positioned between said first projection and the associated partition wall not facing the associated ink supply port, and engaging said porous member.

30. The ink-jet type recording apparatus of claim 29, wherein the porous member associated with each second chamber and the associated first chamber contain ink different from the ink in the other first and second chambers.

31. The ink-jet type recording apparatus of claim 29, wherein a pressure balance between each of said first chambers and each of said associated second chambers is maintained by the surface tension of each of said associated porous members in the vicinity of each of said associated communicating holes, each said porous member resiliently contacting said associated communicating hole, said pressure balance maintaining ink in each of said respective first chambers.

32. The ink-jet type recording apparatus of claim 31, wherein each said porous member, associated first and second chambers, partition wall, communication hole, ink supply port and air vent port are positioned and dimensioned so that when said ink impregnated in each of said associated porous members is at least partially transmitted through said ink supply port, said pressure balance between said associated chambers is no longer maintained and ink is supplied from the first chamber to the associated porous member in the associated second chamber as required until the pressure balance is restored.

33. The ink-jet type recording apparatus of claim 32, further comprising an associated step portion formed at a lower portion of each of said communicating holes, a groove connecting said associated first and second chambers being formed in said ink cartridge below said associated step portion.

34. The ink-jet type recording apparatus of claim 32, further comprising a protrusion portion formed on an inner surface of said partition wall in each of said second chambers, each said protrusion portion maintaining a space about said associated communicating hole to aid in the flow of ink therethrough.

35. The ink-jet type recording apparatus of claim 32, further comprising a step portion formed below each of said communicating holes.

36. The ink-jet type recording apparatus of claim 35, wherein the part of each of said step portions adjacent said associated first chamber is higher than the part adjacent said associated second chamber.

37. The ink-jet type recording apparatus of claim 32, further comprising a respective vertically extending thin groove formed in each said partition wall above each communicating hole and on the side of the associated second chambers, each of said grooves being in fluid communication with each associated communicating hole, each of said grooves aiding in the flow of air and ink between said associated first and second chambers.

38. The ink-jet type recording apparatus of claim 37, wherein said each of said plurality of ink supply ports extend into said respective one of said plurality of second chambers in a direction essentially parallel to said plane defined by said respective vertically extending thin groove.

39. The ink-jet type recording apparatus of claim 32, further comprising a respective vertically extending rib formed on an inner surface of said first chamber, each of said ribs assisting in the flow of ink.

40. The ink-jet type recording apparatus of claim 29, wherein said projection is disposed on a surface of said second chamber opposite said associated ink supply port, said projections compressing said associated porous members against said associated ink supply ports.

41. The ink-jet type recording apparatus of claim 40, wherein each said ink supply port includes a portion including its entrance projecting into said second chamber.

42. The ink-jet type recording apparatus of claim 40, wherein the volume of each of said porous members before placement in a second chamber is larger than the volume of the associated second chamber in which it is received.

43. The ink-jet type recording apparatus of claim 29, wherein the volume of each of said porous members is larger than the capacity of each of said associated second chambers.

44. The ink-jet type recording apparatus of claim 29, further comprising at least one chamber partition wall, said chamber partition wall extending substantially perpendicularly from each said partition wall and dividing said first chamber into a plurality of such chambers while permitting communication between each such chamber and the associated second chamber through the associated communicating hole.

45. The ink-jet type recording apparatus of claim 29, wherein said first chamber and said second chamber are maintained at a pressure less than atmospheric pressure and said ink cartridge further comprises a plurality of air vent ports formed in a surface of said cartridge, each having an air-impermeable sealing member for selectively sealing said air vent ports when said ink cartridge is not in use and unsealing said air vent ports when said ink cartridge is to be used.

46. The ink-jet type recording apparatus of claim 45, wherein each of said air vent ports is formed in part as a groove on the outside surface of a wall of said second chamber and the associated sealing member covering said grooves.

47. The ink-jet type recording apparatus of claim 46, wherein said outside surface is of a top lid.

48. The ink-jet type recording apparatus of claim 46, wherein said sealing member comprises a main portion, and a tongue piece which is removably connected to said main portion via a neck portion.

49. The ink-jet type recording apparatus of claim 48, wherein at least one of different patterns and colors are printed on said main portion and said tongue piece, said neck portion acting as a boundary between said main portion and said tongue piece.

50. The ink-jet type recording apparatus of claim 45, further comprising at least one chamber partition wall extending from each partition, said chamber partition walls dividing each said first chambers into a plurality of sub-chambers.

51. The ink-jet type recording apparatus of claim 45, wherein the volume of each of said porous members before placement in a second chamber is larger than the volume of the associated second chamber in which it is received.

52. The ink-jet type recording apparatus of claim 45, further comprising a respective vertically extending rib formed on an inner face of each of said first chambers, each of said ribs assisting in the flow of ink.

53. The ink-jet type recording apparatus of claim 45, wherein each said air vent port is formed in part as a meandering groove, said sealing member forming at least a portion of said air vent port.

54. The ink-jet type recording apparatus of claim 29, wherein the volume of each of said porous members before placement in a second chamber is larger than the volume of the associated second chamber in which it is received.

55. The ink-jet type recording apparatus of claim 29 wherein said second chamber is a foam chamber and said first chamber is an ink chamber.

56. The ink-jet type recording apparatus of claim 29, wherein said cartridge is constructed to be removably mounted on said recording apparatus so that one of a plurality of ink supply needles of said apparatus is received in each ink supply port.

57. A method for providing ink to an ink-jet type recording head, comprising the steps of:

providing an ink tank cartridge having a plurality of first chambers adapted to store ink and a plurality of second chambers adapted to receive a respective porous member impregnated with ink;

separating each of said first and second chambers from each other by use of a partition wall;

communicating ink between said associated first and second chambers through a communicating hole adjacent the bottom of said partition, said communicating hole essentially defining a plane;

withdrawing ink from each porous member in each second chamber through an ink supply port extending from a bottom wall of each second chamber into a respective one of said second chambers in a direction essentially parallel to said plane defined by said respective communicating hole; and providing ambient air to each second chamber through an air vent communicating between each said second chamber and the exterior of said cartridge at a location in a top wall of said second chamber; and forming an air pocket between each said air vent and said porous member by engaging each porous member by at least two projections compressing said porous member in the region of the associated ink supply port by a first of said projections which faces said associated ink supply port, providing a second of said projections between said first projection and the associated partition wall of a length less than that of said first projection, so that said porous member is compressed in the region of the associated ink supply port to an extent greater than in the region of the associated communicating hole.

58. The method of claim 57, further comprising the steps of:

maintaining the pressure in each of said first and second chambers below normal atmospheric pressure;

maintaining a pressure balance between each pair of associated first and second chambers by the surface tension of said porous member in the vicinity of said communicating hole;

the withdrawal of ink from a porous member through an associated ink supply port upsetting the pressure balance between said associated first and second chambers so that ink flows from said first chamber to said second chamber until said pressure balance is restored.

59. The method of claim 57, further comprising the steps of:

forming air vents at least in part as winding grooves in a surface of said ink tank cartridge to protect said ink against evaporation.

60. The method of claim 59, further comprising the steps of:

sealing said grooves with a said seal member;

removing a portion of said seal to place the interior of said ink supply tank in fluid communicating with ambient air through said winding grooves.

61. The method of claim 57, including providing ambient air to each of said first chambers from the associated air vent at least in part along at least one groove formed above said communicating hole in said associated partition wall on the side facing said second chamber when ink flows from said first chamber into the associated porous member, said at least one groove being in fluid communication with said communicating hole.

62. The method of claim 61, including compressing each said ink absorbing member by providing a portion of each of the associated ink supply ports which extends into the interior of the associated second chamber.

* * * * *